US009841231B2

(12) United States Patent
Qualls et al.

(10) Patent No.: US 9,841,231 B2
(45) Date of Patent: Dec. 12, 2017

(54) LNG FACILITY WITH INTEGRATED NGL RECOVERY FOR ENHANCED LIQUID RECOVERY AND PRODUCT FLEXIBILITY

(75) Inventors: Wesley Qualls, Katy, TX (US); Weldon L. Ransbarger, Houston, TX (US); Shawn S. Huang, Spring, TX (US); Jame Yao, Sugar Land, TX (US); Doug Elliot, Houston, TX (US); Jong Juh Chen, Sugar Land, TX (US); Rong-Jwyn Lee, Sugar Land, TX (US)

(73) Assignee: ConocoPhillips Company, Houston, TX (US)

( * ) Notice: Subject to any disclaimer, the term of this patent is extended or adjusted under 35 U.S.C. 154(b) by 1550 days.

(21) Appl. No.: 13/282,936

(22) Filed: Oct. 27, 2011

(65) Prior Publication Data

US 2012/0042690 A1 Feb. 23, 2012

Related U.S. Application Data

(63) Continuation of application No. 11/426,026, filed on Jun. 23, 2006.

(Continued)

(51) Int. Cl.

*F25J 3/00* (2006.01)
*F25J 1/02* (2006.01)

(Continued)

(52) U.S. Cl.

CPC ..... *F25J 1/0265* (2013.01); *F25J 1/004* (2013.01); *F25J 1/0022* (2013.01); *F25J 1/0035* (2013.01); *F25J 1/0045* (2013.01); *F25J 1/0052* (2013.01); *F25J 1/021* (2013.01); *F25J 1/0238* (2013.01); *F25J 3/0209* (2013.01); *F25J 3/0233* (2013.01); *F25J 3/0238* (2013.01); *F25J 3/0242* (2013.01); *F25J 3/0247* (2013.01); *F25J 2200/04* (2013.01); *F25J 2200/08* (2013.01); *F25J 2200/40* (2013.01); *F25J 2200/50* (2013.01);

(Continued)

(58) Field of Classification Search

CPC ..... F25J 3/0209; F25J 3/0233; F25J 3/0238; F25J 3/0242; F25J 1/0207

USPC ..... 62/630, 635

See application file for complete search history.

(56) References Cited

U.S. PATENT DOCUMENTS 4,111,637 A 5/1978 Hillman, II
4,277,254 A 7/1981 Hanson (Continued)

FOREIGN PATENT DOCUMENTS

JP 2001208297 8/2001

OTHER PUBLICATIONS

Chilean Patent Office, Office Communication dated Apr. 24, 2012 for Chilean Application No. 1793-2006.

(Continued)

*Primary Examiner* — John F Pettitt

(74) *Attorney, Agent, or Firm* — ConocoPhillips Company

(57) ABSTRACT

Process for efficiently operating a natural gas liquefaction system with integrated heavies removal/natural gas liquids recovery to produce liquefied natural gas (LNG) and/or natural gas liquids (NGL) products with varying characteristics, such as, for example higher heating value (HHV) and/or propane content. Resulting LNG and/or NGL products are capable of meeting the significantly different specifications of two or more markets.

3 Claims, 17 Drawing Sheets

Related U.S. Application Data

Figure 1A:
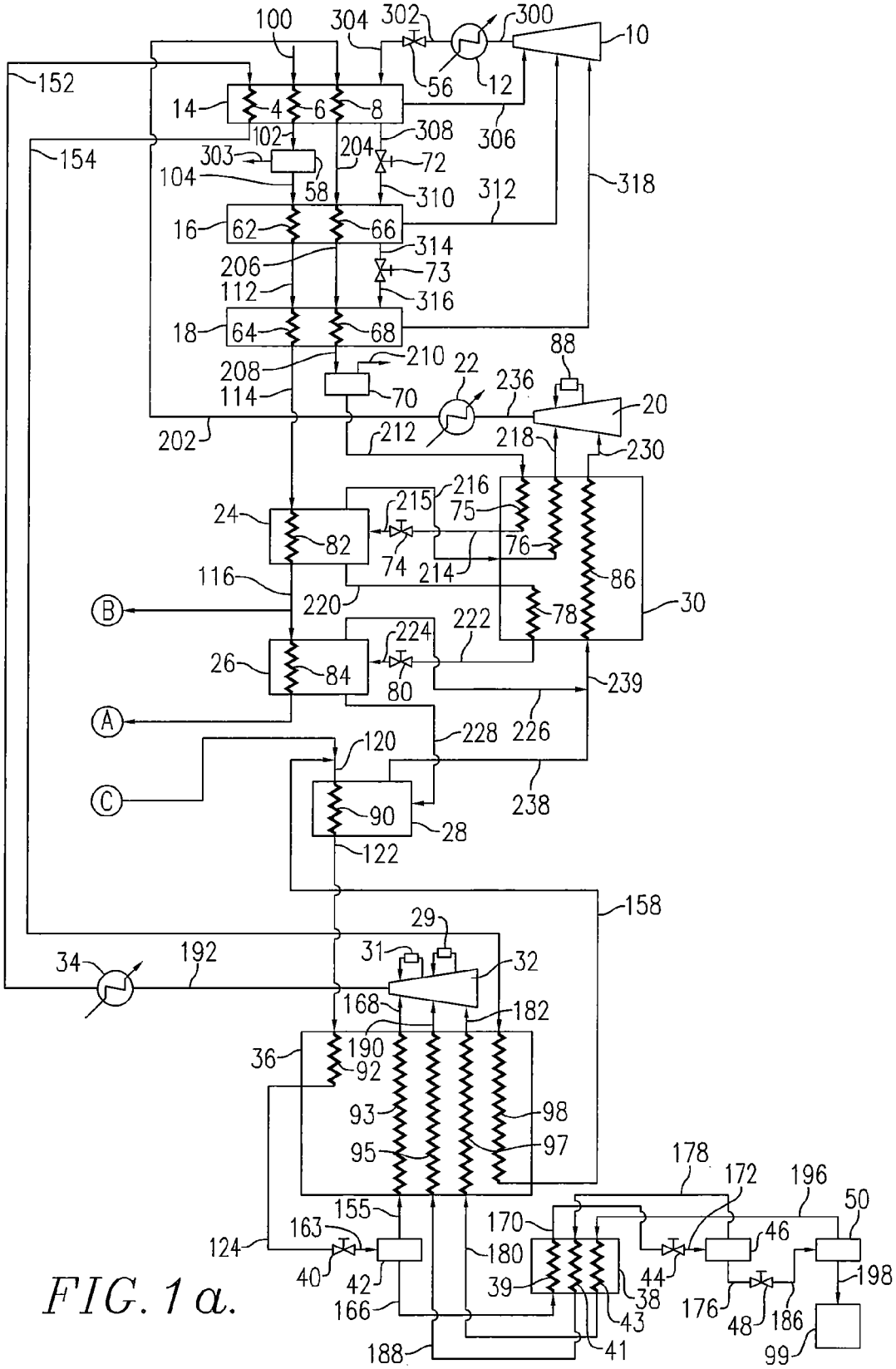

(60) Provisional application No. 60/698,402, filed on Jul. 12, 2005.

(51) Int. Cl.
*F25J 1/00* (2006.01)
*F25J 3/02* (2006.01)

(52) U.S. Cl.
CPC ..... *F25J 2200/70* (2013.01); *F25J 2200/74* (2013.01); *F25J 2200/78* (2013.01); *F25J 2205/04* (2013.01); *F25J 2205/50* (2013.01); *F25J 2210/06* (2013.01); *F25J 2215/62* (2013.01); *F25J 2230/08* (2013.01); *F25J 2235/60* (2013.01); *F25J 2240/02* (2013.01); *F25J 2245/02* (2013.01); *F25J 2270/02* (2013.01); *F25J 2270/12* (2013.01); *F25J 2270/60* (2013.01); *F25J 2280/02* (2013.01); *F25J 2290/40* (2013.01)

(56) References Cited

U.S. PATENT DOCUMENTS 4,435,198 A 3/1984 Gray
RE33,408 E * 10/1990 Khan ..... C07C 7/09 62/621
6,125,653 A 10/2000 Shu et al.
6,722,157 B1 * 4/2004 Eaton ..... F25J 1/0095 62/612
7,257,966 B2 * 8/2007 Lee ..... F25J 3/0209 62/620
2003/0226373 A1 12/2003 Prible et al.
2004/0025535 A1 * 2/2004 Mak ..... F25J 3/0209 62/620
2004/0079107 A1 4/2004 Wilkinson et al.
2004/0206112 A1 10/2004 Mak
2004/0261452 A1 12/2004 Mak et al.
2005/0204625 A1 9/2005 Briscoe et al.
2006/0042312 A1 3/2006 Winningham

OTHER PUBLICATIONS

Japanese Patent Office, Office Communication dated Jun. 12, 2012 for Japanese application No. 2008-521451.

Japanese Patent Office, Office Communication dated Mar. 23, 2010, for Japanese Application No. 200680033300.3.

Japanese Patent Office, Office Communication dated Mar. 23, 2012, for Japanese Application No. 200680033300.3.

* cited by examiner

LNG FACILITY WITH INTEGRATED NGL RECOVERY FOR ENHANCED LIQUID RECOVERY AND PRODUCT FLEXIBILITY

RELATED APPLICATIONS

This application is a continuation of application U.S. patent Ser. No. 11/426,026, filed Jun. 23, 2006, which claims priority benefit under 35 U.S.C. Section 119(e) of U.S. Provisional Patent Ser. No. 60/698,402 filed Jul. 12, 2005, the entire disclosure of which is incorporated herein by reference.

BACKGROUND OF THE INVENTION

1. Field of the Invention

This invention relates generally to a method and apparatus for liquefying natural gas. In another aspect, the invention concerns an improved liquefied natural gas (LNG) facility capable of efficiently supplying LNG products meeting significantly different product specifications.

2. Description of the Prior Art

The cryogenic liquefaction of natural gas is routinely practiced as a means of converting natural gas into a more convenient form for transportation and/or storage. Generally, liquefaction of natural gas reduces its volume by about 600-fold, thereby resulting in a liquefied product that can be readily stored and transported at near atmospheric pressure.

Natural gas is frequently transported by pipeline from the supply source to a distant market. It is desirable to operate the pipeline under a substantially constant and high load factor, but often the deliverability or capacity of the pipeline will exceed demand while at other times the demand will exceed the deliverability of the pipeline. In order to shave off the peaks where demand exceeds supply or the valleys where supply exceeds demand, it is desirable to store the excess gas in such a manner that it can be delivered as the market dictates. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source that is separated by great distances from the candidate market, and a pipeline either is not available or is impractical. This is particularly true where transport must be made by ocean-going vessels. Ship transportation of natural gas in the gaseous state is generally not practical because appreciable pressurization is required to significantly reduce the specific volume of the gas, and such pressurization requires the use of more expensive storage containers.

In view of the foregoing, it would be advantageous to store and transport natural gas in the liquid state at approximately atmospheric pressure. In order to store and transport natural gas in the liquid state, the natural gas is cooled to B240° F. to B260° F. where the liquefied natural gas (LNG) possesses a near-atmospheric vapor pressure.

Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology that may be particularly applicable to one or more embodiments of the present invention employs an open methane cycle for the final refrigeration cycle wherein a pressurized LNG-bearing stream is flashed and the flash vapors are subsequently employed as cooling agents, recompressed, cooled, combined with the processed natural gas feed stream, and liquefied, thereby producing the pressurized LNG-bearing stream.

In the past, LNG facilities have been designed and operated to provide LNG to a single market in a certain region of the world. As global demand for LNG increases, it would be advantageous for a single LNG facility to be able to supply LNG to multiple markets in different regions of the world. However, natural gas specifications vary greatly throughout the world. Typically, such natural gas specifications include criteria such as higher heating value (HHV), Wobbe index, methane content, ethane content, $C_{3+}$ content, and inerts content. For example, different world markets demand an LNG product having an HHV anywhere between 950 and 1160 BTU/SCF. Existing LNG facilities are optimized to meet a certain set of specifications for a single market. Thus, changing the operating parameters of an LNG facility in an effort to make LNG that would meet the non-design specifications of a different market creates significant operating inefficiencies in the facility. These operating inefficiencies associated with producing LNG for non-design specifications generally makes it economically unfeasible to serve more than one market with a single LNG facility.

SUMMARY OF THE INVENTION

In one embodiment of the present invention there is provided a process for producing liquefied natural gas (LNG). The process includes the following steps: (a) operating an LNG facility in a first mode of operation to thereby produce a first LNG product; (b) adjusting at least one non-feed operating parameter of the LNG facility so that the LNG facility operates in a second mode of operation; and (c) operating the LNG facility in the second mode of operation to thereby produce a second LNG product. The first and second modes of operation are not to be carried out during start-up or shut-down of the LNG facility. Steps (a) and (c) can, optionally, include producing first and second natural gas liquids (NGL) products respectively. The average higher heating value (HHV) of the second LNG product is at least about 10 BTU/SCF different than the average HHV of the first LNG product and/or the average propane content of the second NGL product is at least about 1 mole percent different than the average propane content of the first NGL product.

In another embodiment of the present invention there is provided a method of varying the heating value of LNG produced from an LNG facility. The method includes the following steps: (a) cooling natural gas by indirect heat exchange to thereby produce a first cooled stream; (b) using a first distillation column to separate at least a portion of the first cooled stream into a first relatively more volatile fraction and a first relatively less volatile fraction; (c) cooling at least a portion of the first relatively more volatile fraction to thereby produce LNG; and (d) adjusting at least one operating parameter of the first distillation column to thereby vary the HHV of the produced LNG by at least about 1 percent over a time period of less than about 72 hours.

BRIEF DESCRIPTION OF THE DRAWING FIGURES

Figure 1B:
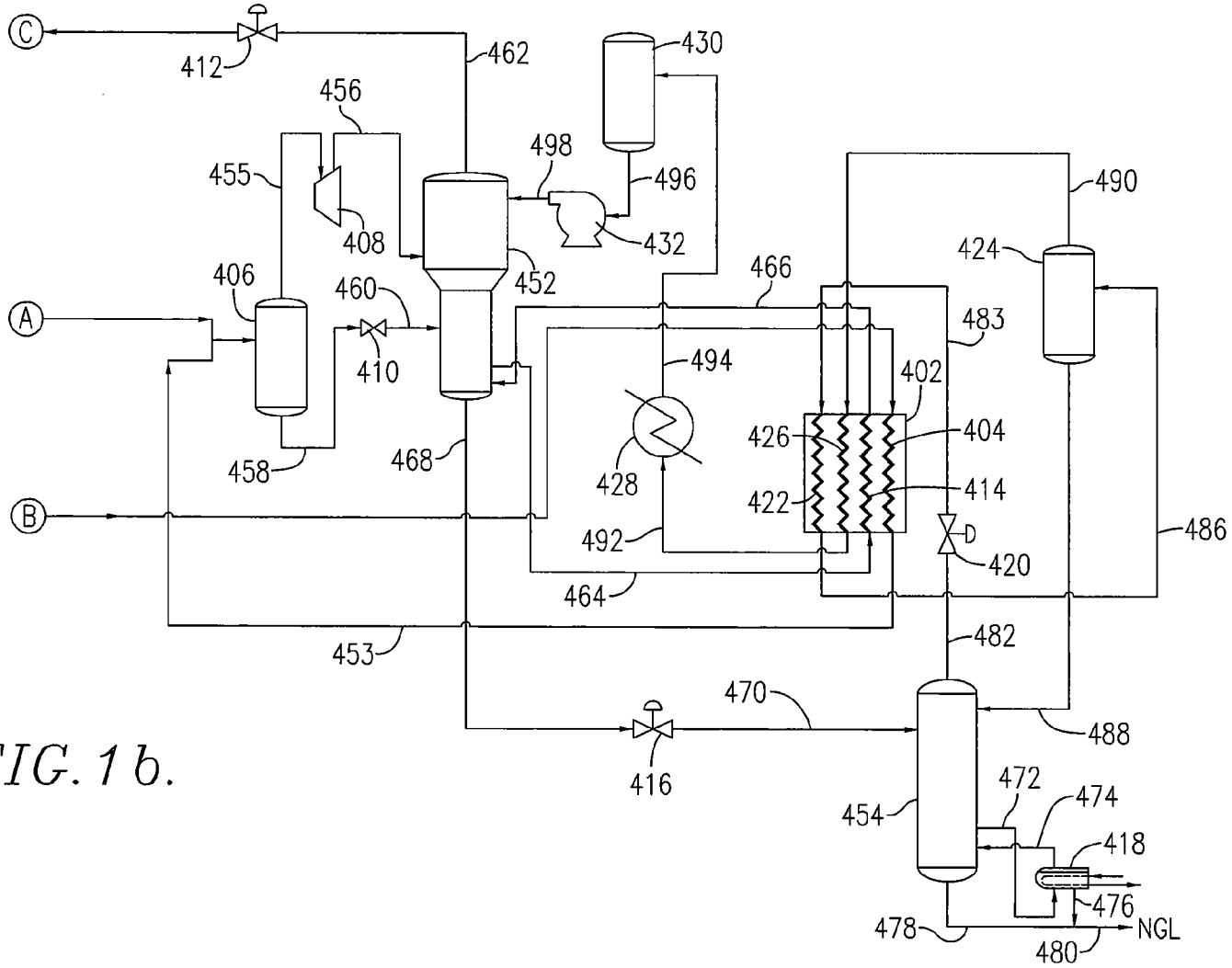

A preferred embodiment of the present invention is described in detail below with reference to the attached drawing figures, wherein:

FIG. 1*a* is a simplified flow diagram of a cascaded refrigeration process for producing LNG to meet significantly different specifications of two or more different markets with certain portions of the LNG facility connecting to lines A, B, and C being illustrated in FIG. 1*b;*

Figure 2A:
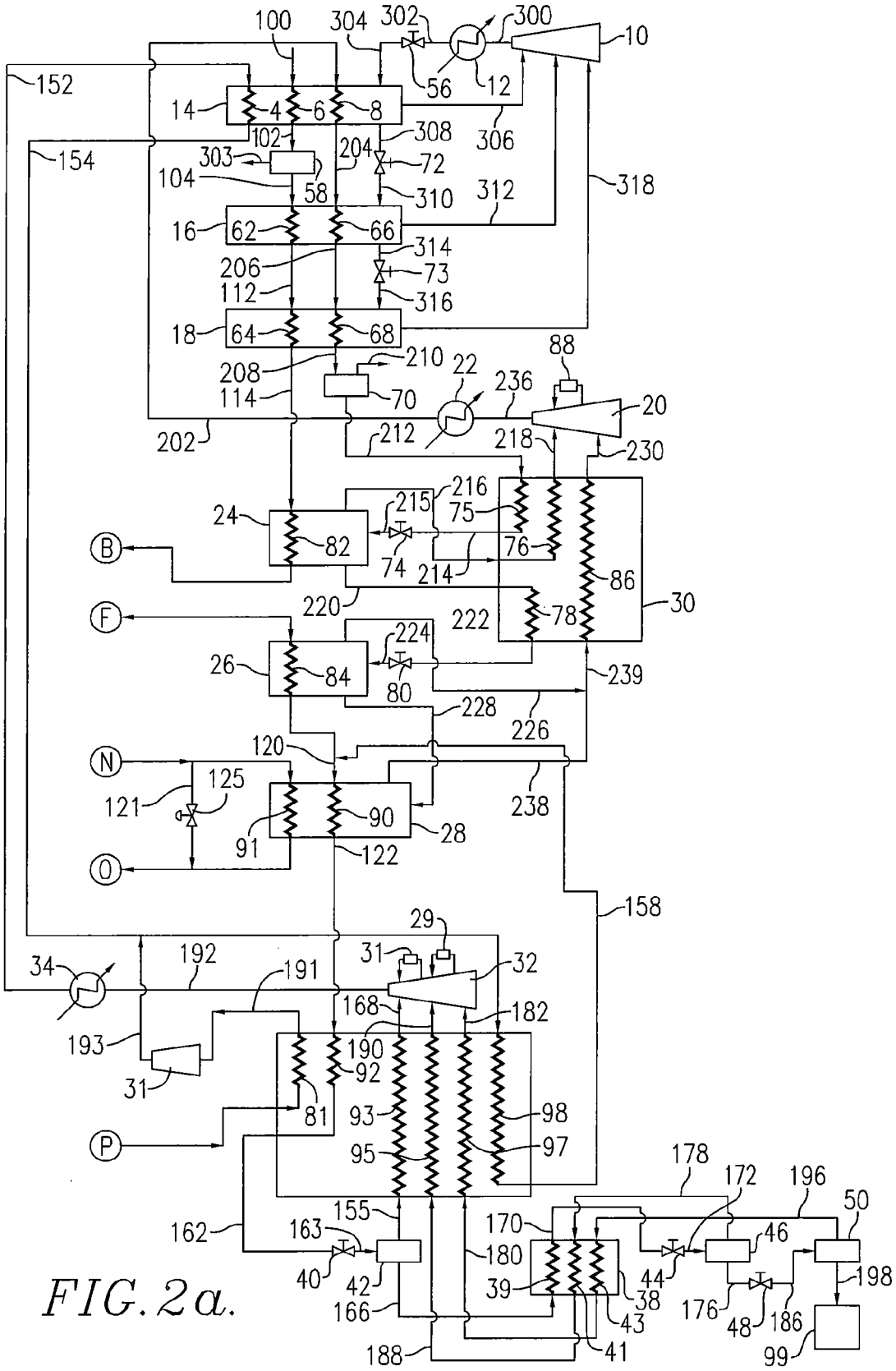
Figure 2B:
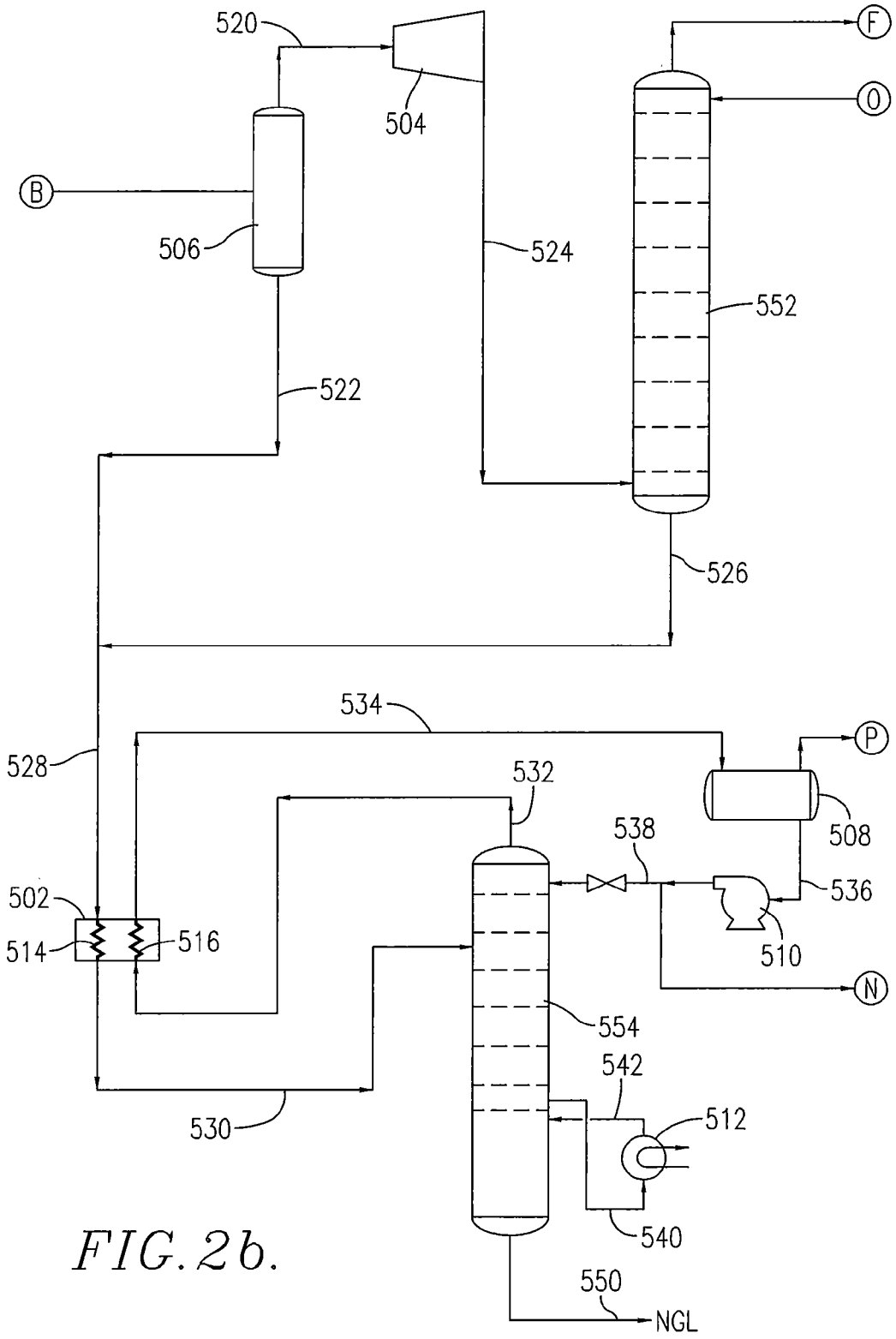

FIG. 1*b* is a flow diagram showing an integrated heavies removal/NGL recovery system connected to the LNG facility of FIG. 1*a* via lines A, B, and C;

FIG. 2*a* is a simplified flow diagram of a cascaded refrigeration process for producing LNG to meet significantly different specifications of two or more different markets with certain portions of the LNG facility connecting to lines B, F, N, O, and P being illustrated in FIG. 2*b;*

Figure 3A:
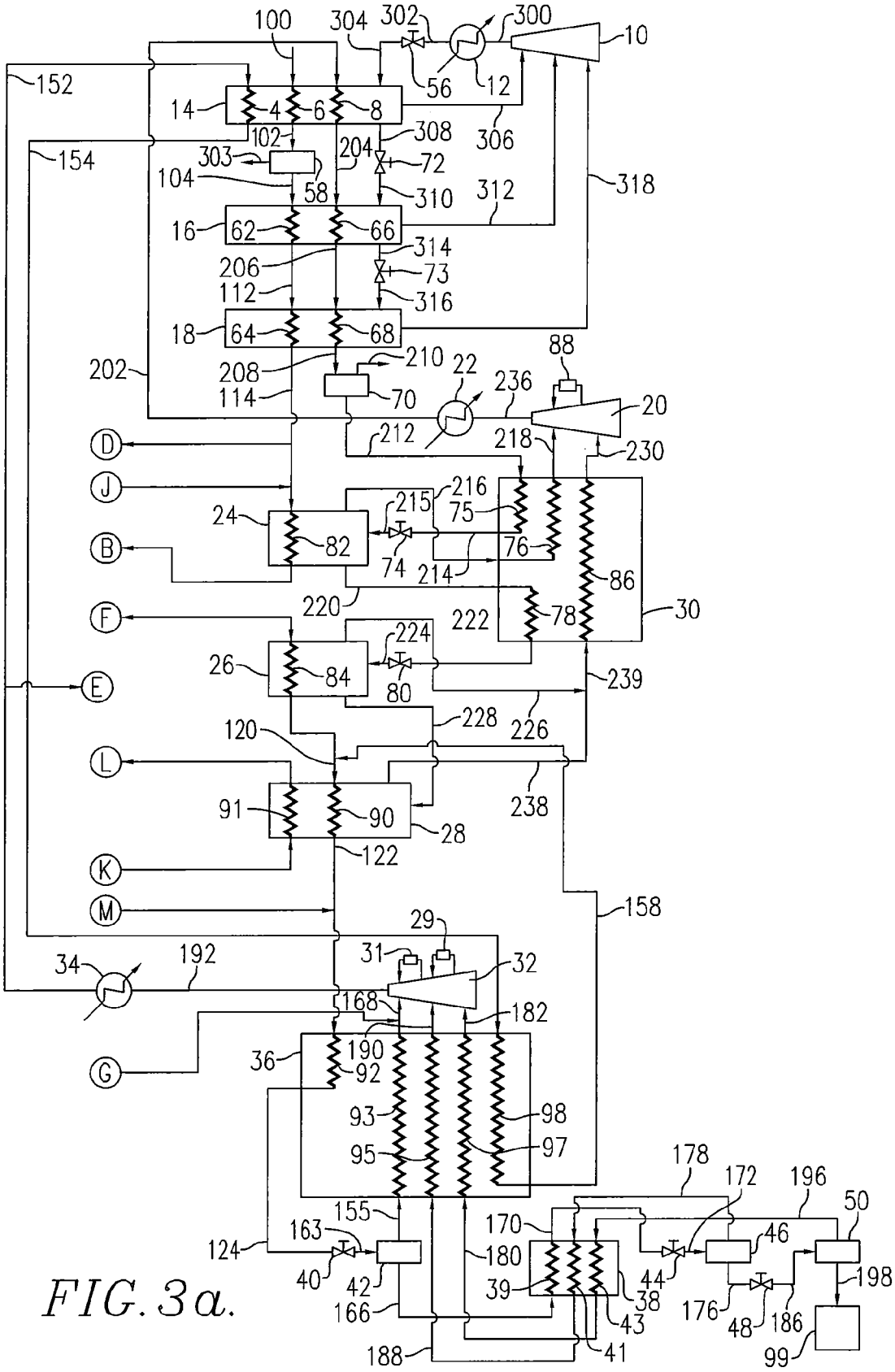

FIG. 2*b* is a flow diagram showing an integrated heavies removal/NGL recovery system connected to the LNG facility of FIG. 2*a* via lines B, F, N, O, and P;

FIG. 3*a* is a simplified flow diagram of a cascaded refrigeration process for producing LNG to meet significantly different specifications of two or more different markets with certain portions of the LNG facility connecting to lines D, J, B, F, E, L, K, M, and G being illustrated in FIGS. 3*b*, 3*c*, 3*d*, and 3*e;*

Figure 3B:
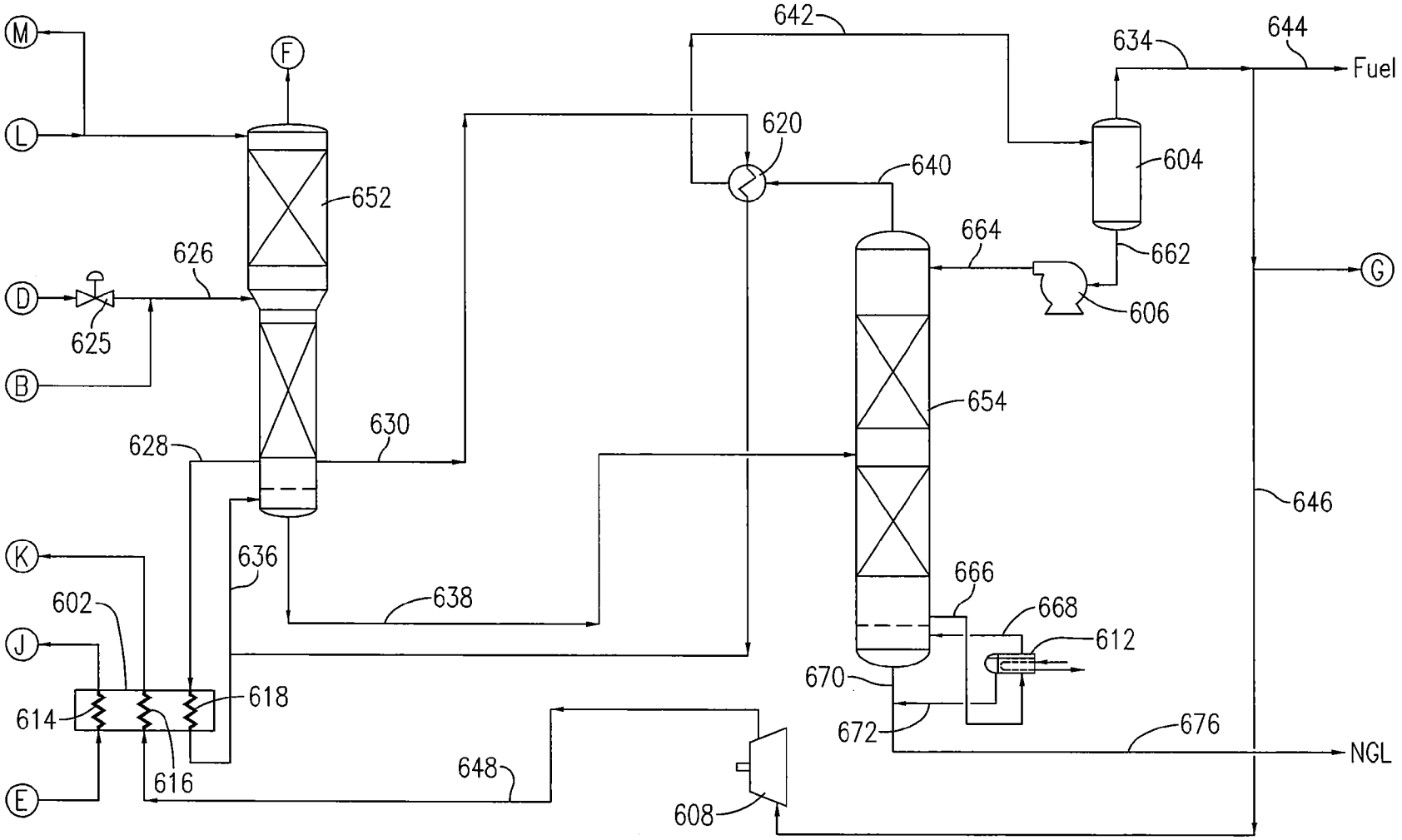
Figure 3C:
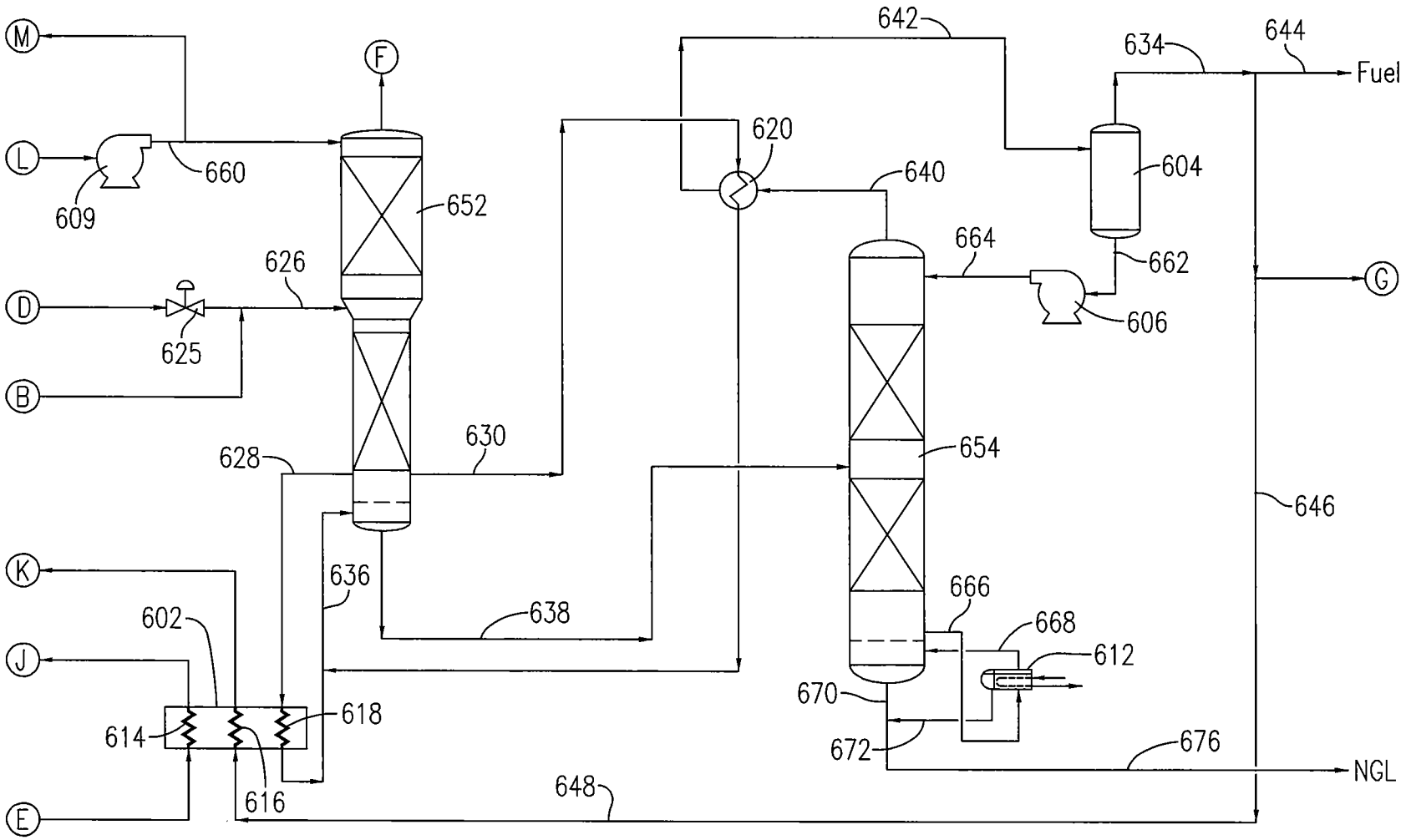
Figure 3D:
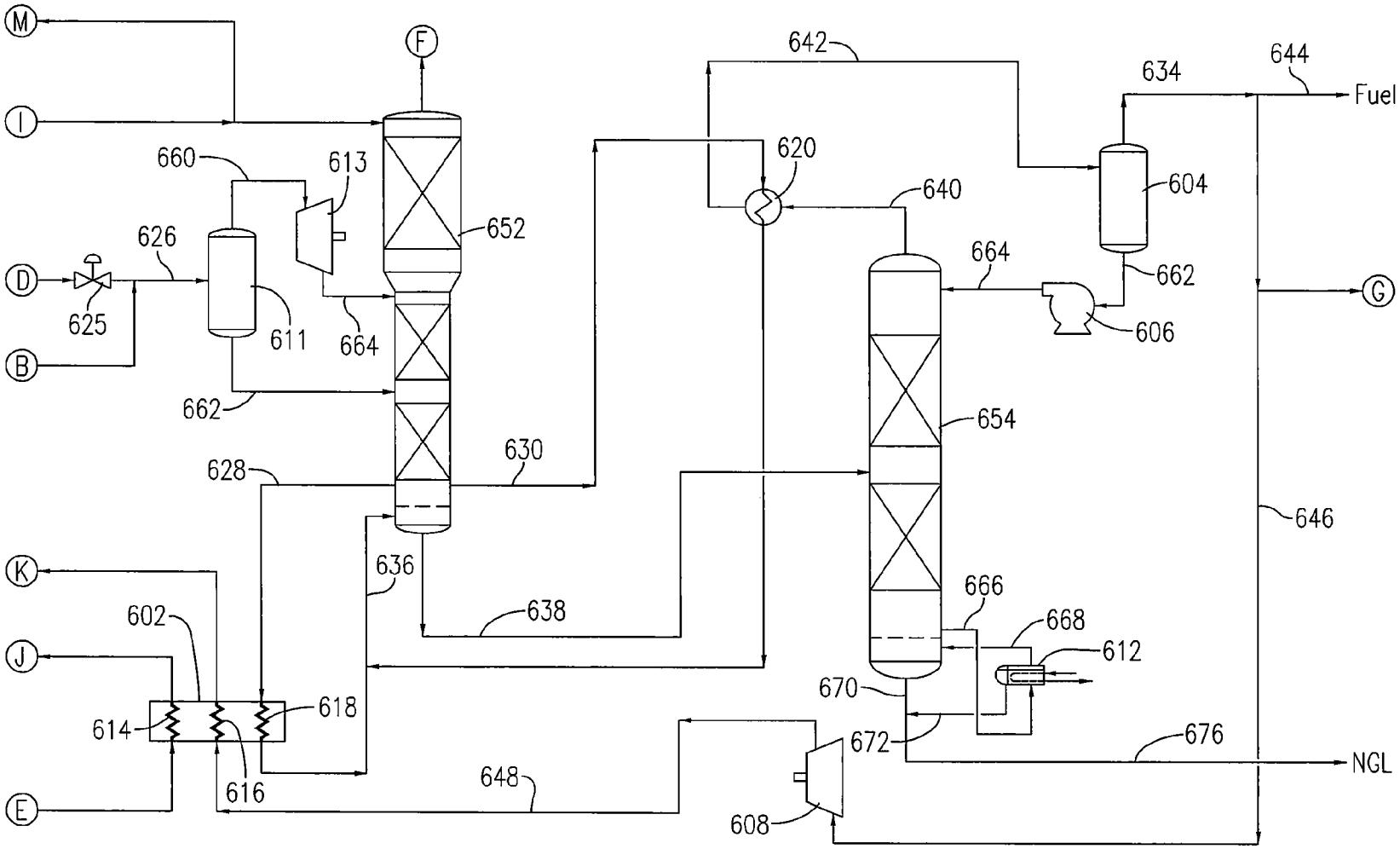
Figure 3E:
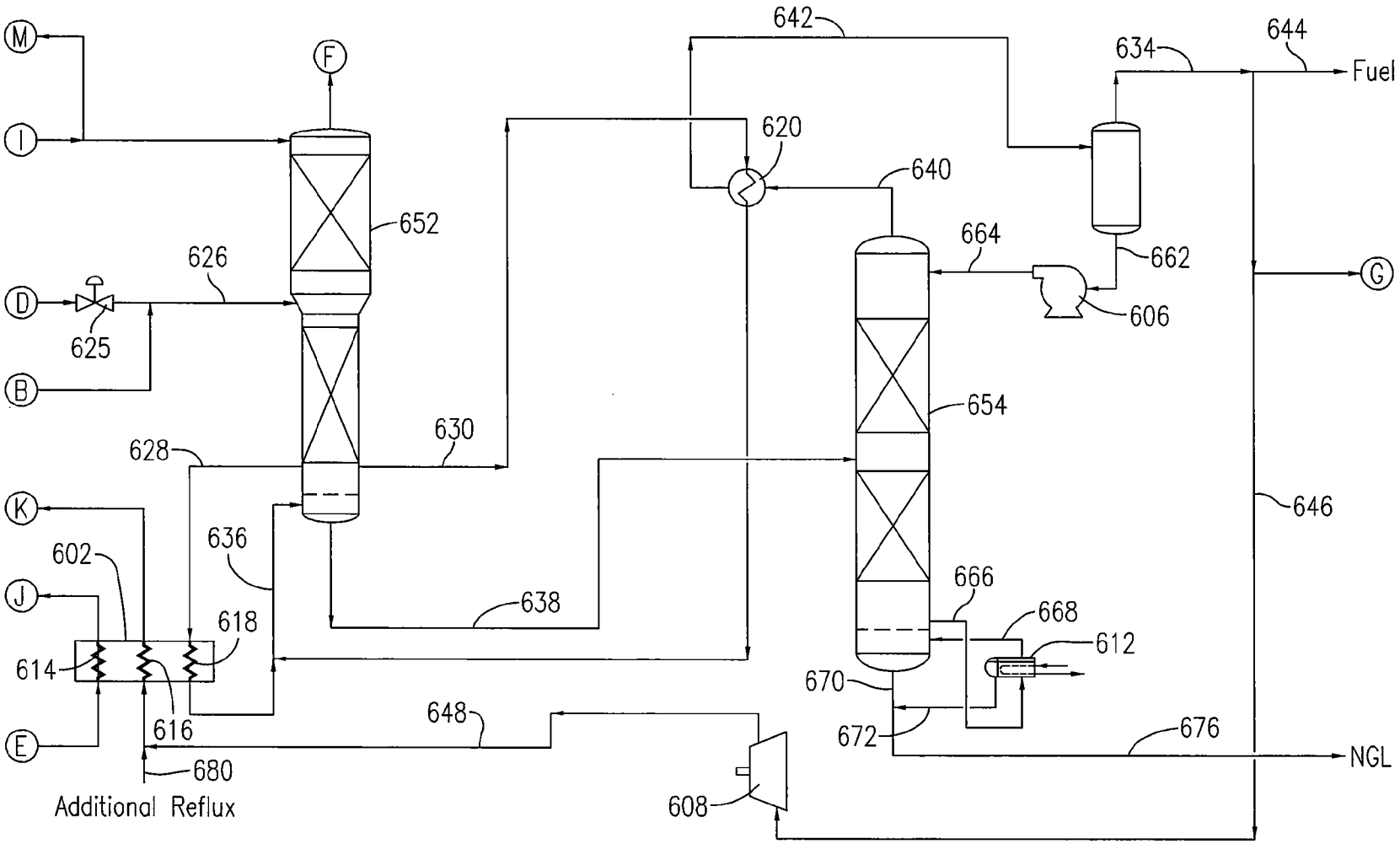
Figure 4A:
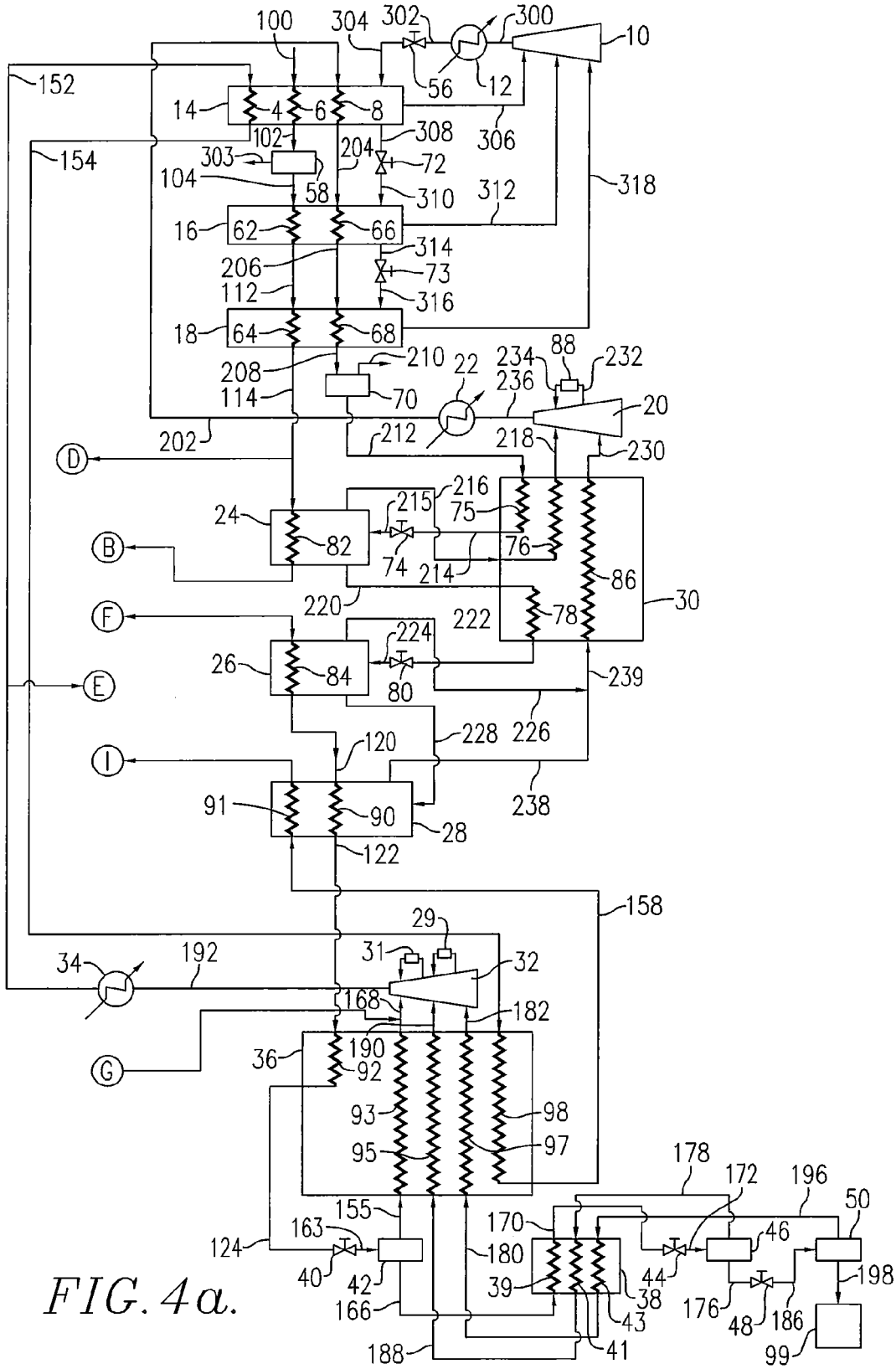
Figure 4B:
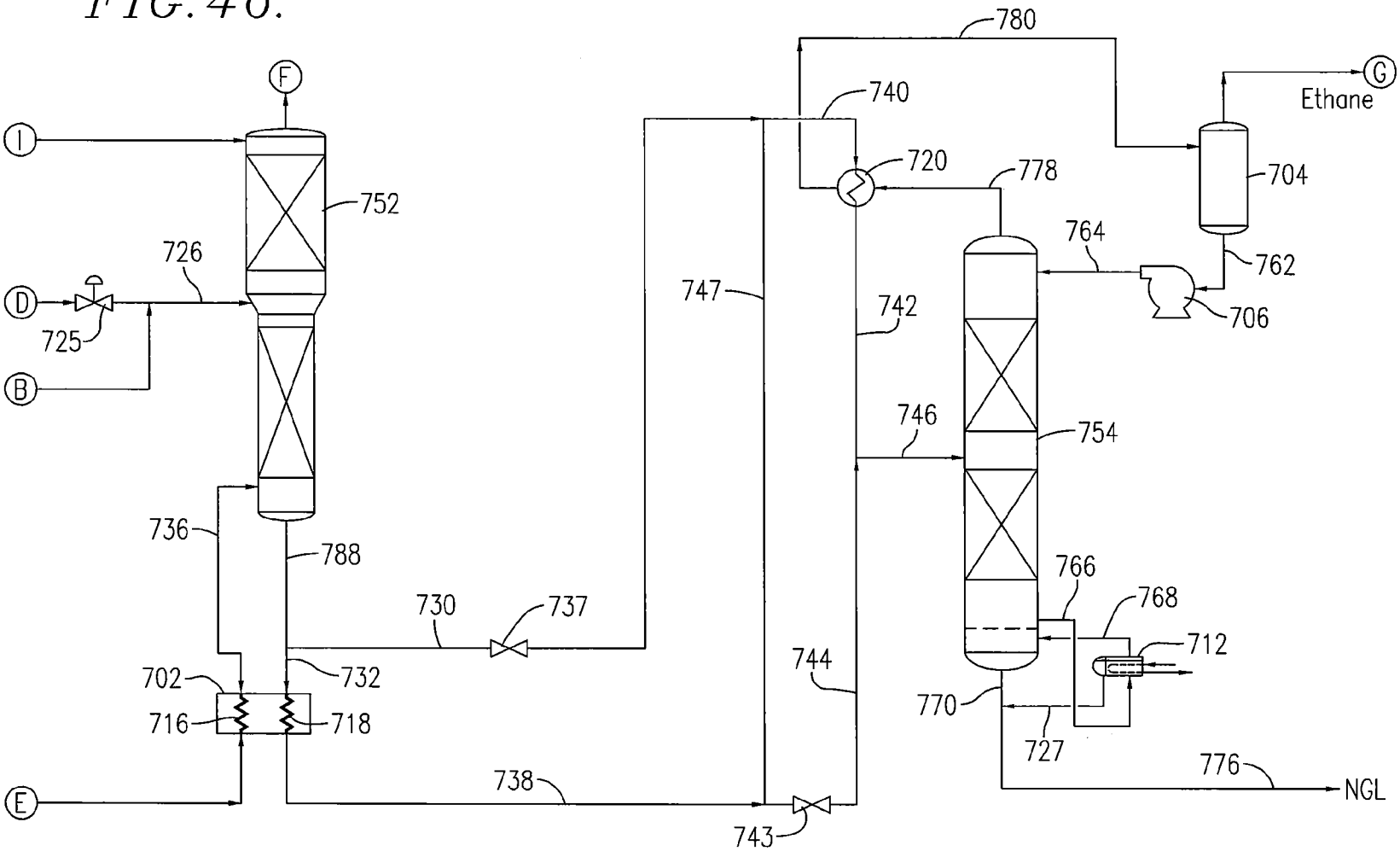

FIG. 3*b* is a flow diagram showing an integrated heavies removal/NGL recovery system connected to the LNG facility of FIG. 3*a* via lines D, J, B, F, E, L, K, M, and G;

FIG. 3*c* is a flow diagram showing an integrated heavies removal/NGL recovery system connected to the LNG facility of FIG. 3*a* via lines D, J, B, F, E, L, K, M, and G;

FIG. 3*d* is a flow diagram showing an integrated heavies removal/NGL recovery system connected to the LNG facility of FIG. 3*a* via lines D, J, B, F, E, L, K, M, and G;

FIG. 3*e* is a flow diagram showing an integrated heavies removal/NGL recovery system connected to the LNG facility of FIG. 3*a* via lines D, J, B, F, E, L, K, M, and G;

FIG. 4*a* is a simplified flow diagram of a cascaded refrigeration process for producing LNG to meet significantly different specifications of two or more different markets with certain portions of the LNG facility connecting to lines D, B, F, E, I, and G being illustrated in FIG. 4*b;*

Figure 5A:
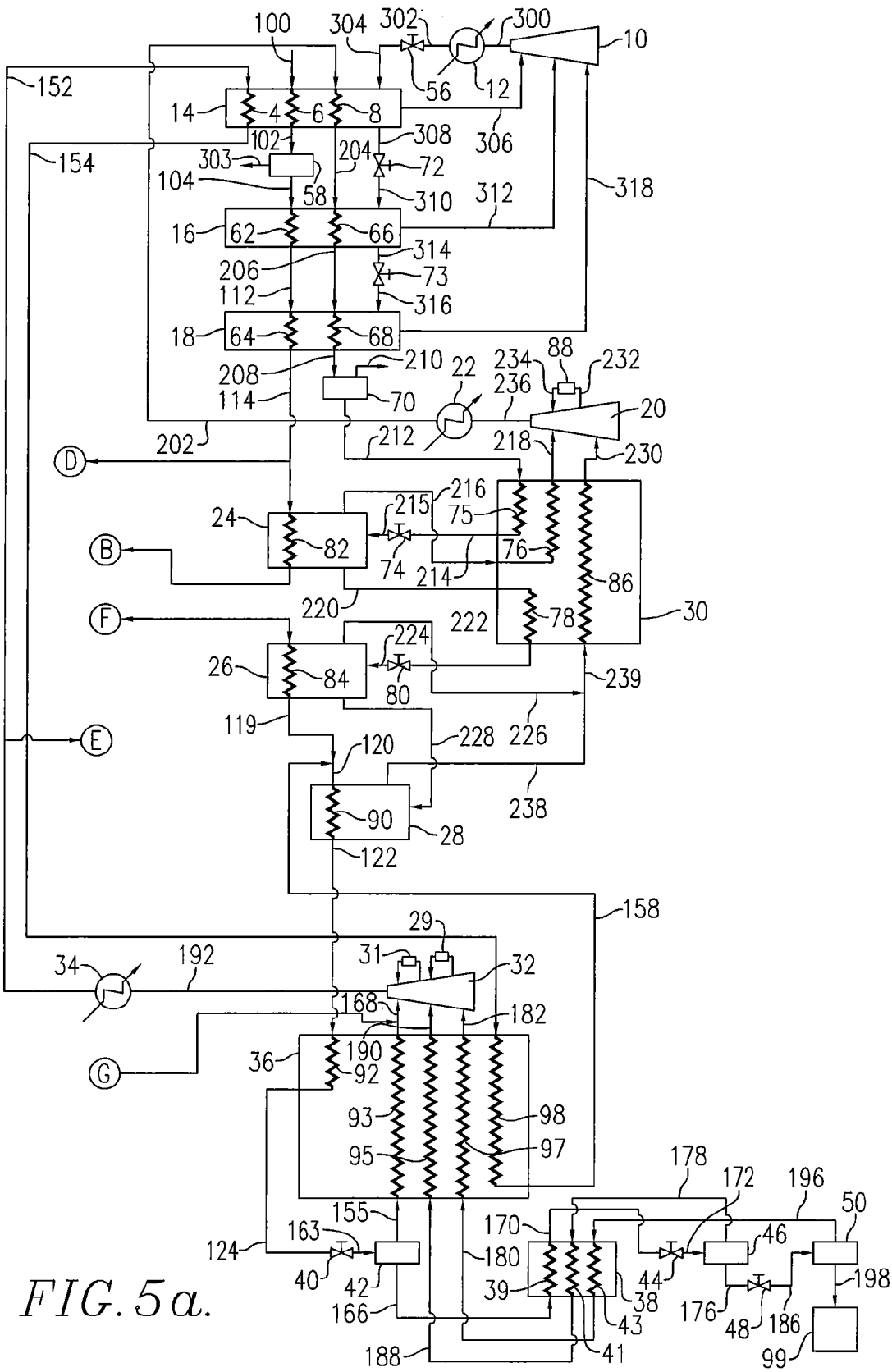
Figure 5B:
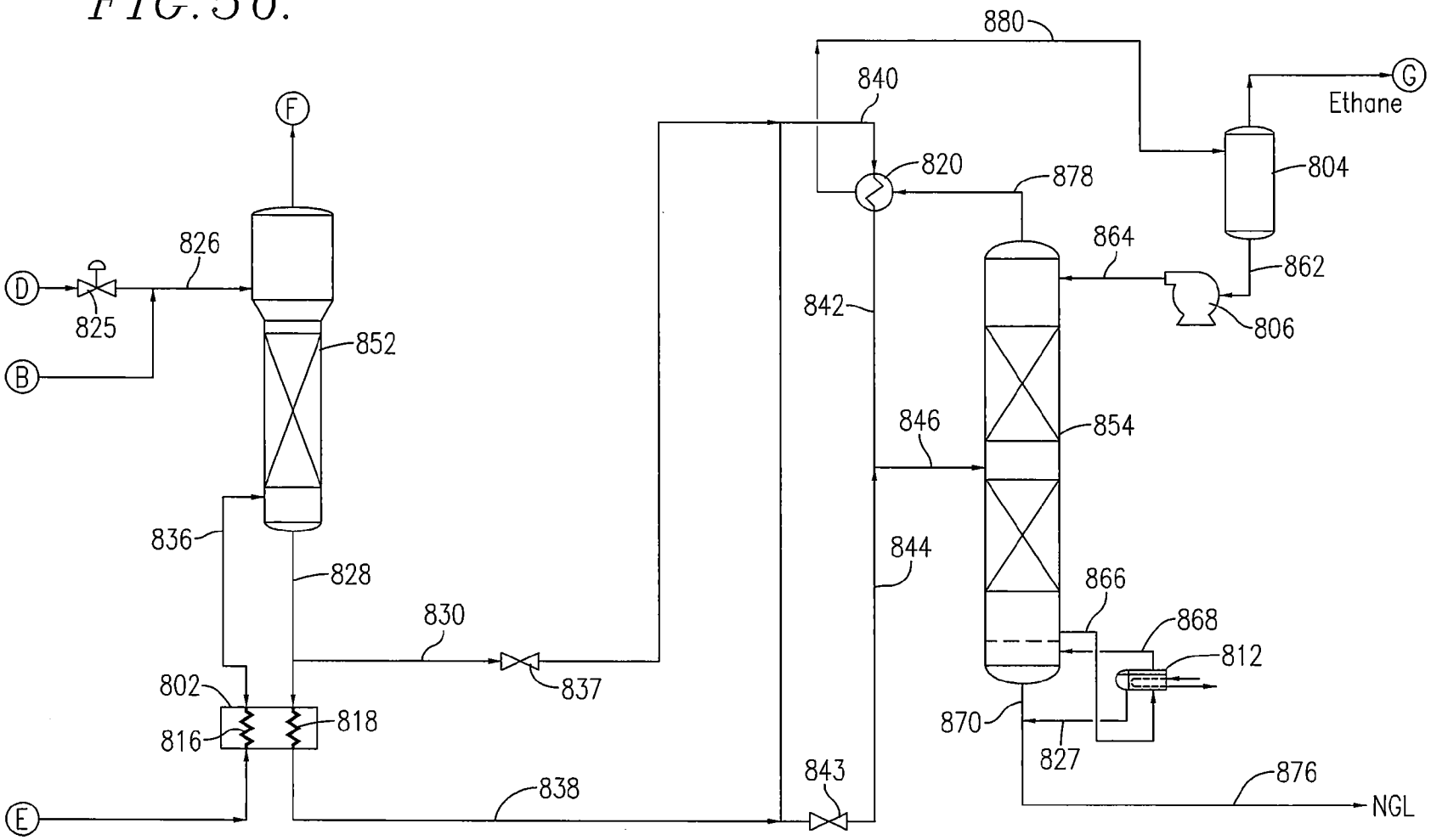

FIG. 4*b* is a flow diagram showing an integrated heavies removal/NGL recovery system connected to the LNG facility of FIG. 4*a* via lines D, B, F, E, I, and G;

FIG. 5*a* is a simplified flow diagram of a cascaded refrigeration process for producing LNG to meet significantly different specifications of two or more different markets with certain portions of the LNG facility connecting to lines D, B, F, E, and G being illustrated in FIG. 5*b;*

Figure 6A:
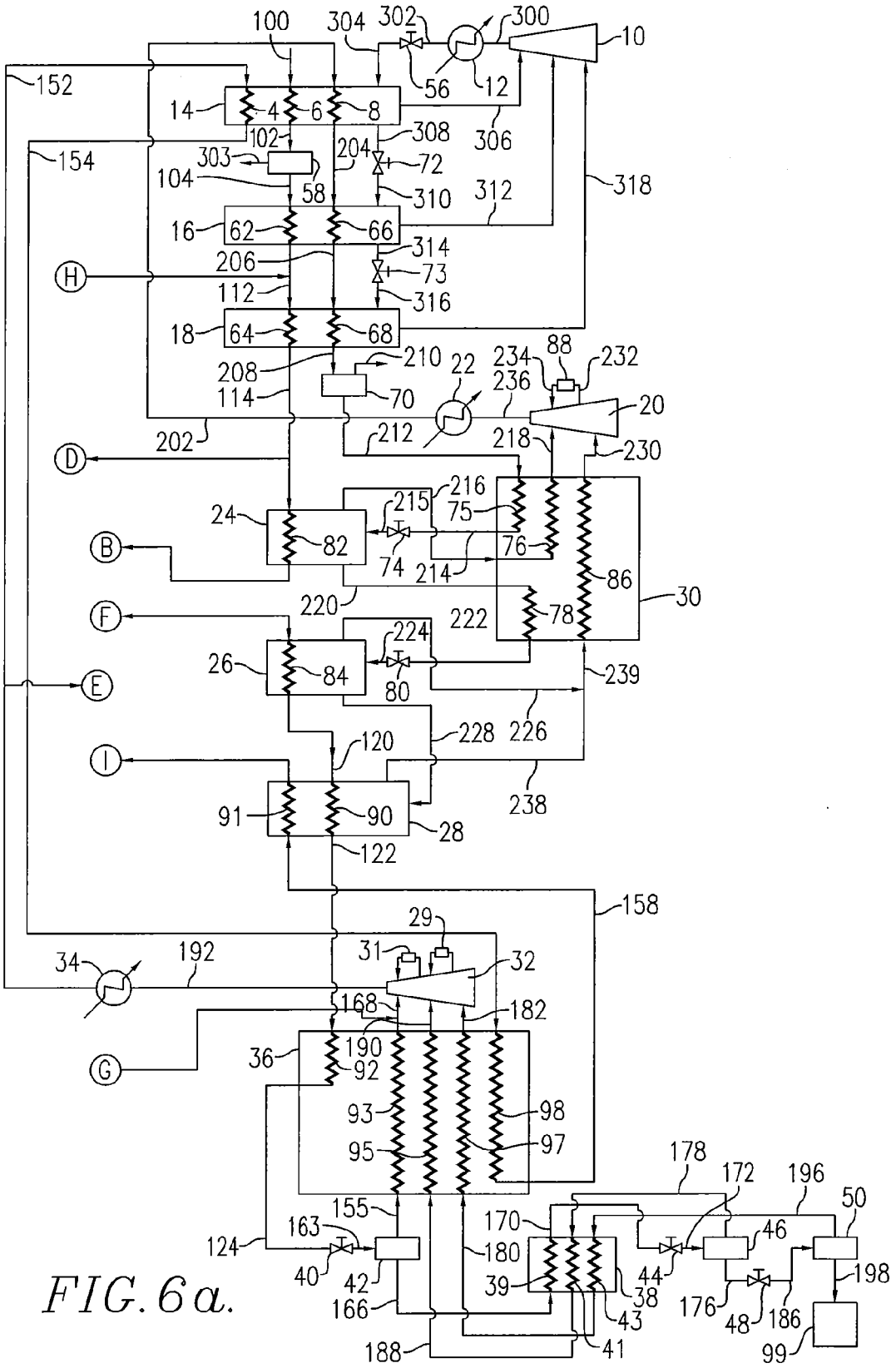
Figure 6B:
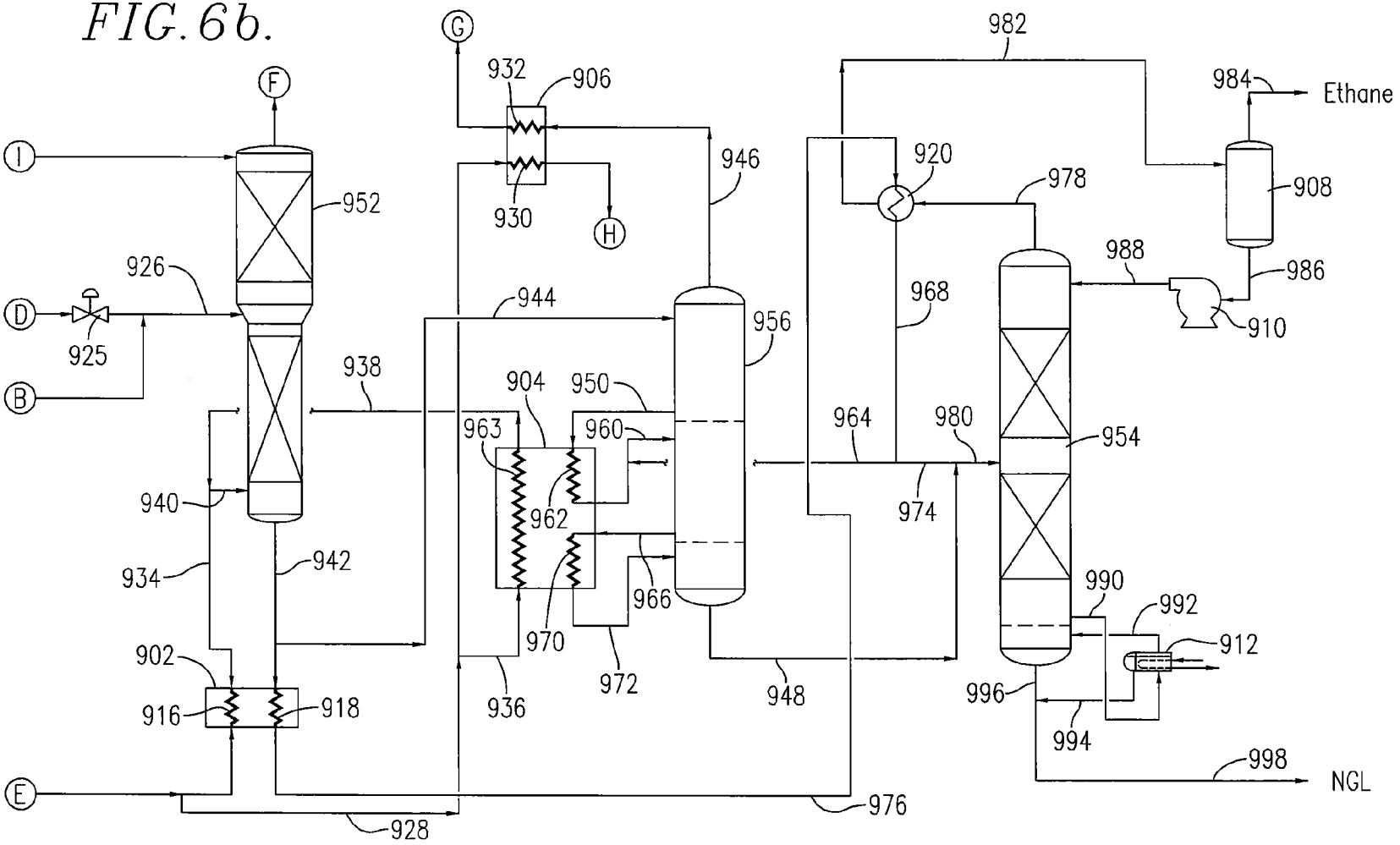

FIG. 5*b* is a flow diagram showing an integrated heavies removal/NGL recovery system connected to the LNG facility of FIG. 5*a* via lines D, B, F, E, and G;

FIG. 6*a* is a simplified flow diagram of a cascaded refrigeration process for producing LNG to meet significantly different specifications of two or more different markets with certain portions of the LNG facility connecting to lines H, D, B, F, E, I, and G being illustrated in FIG. 6*b;*

Figure 7A:
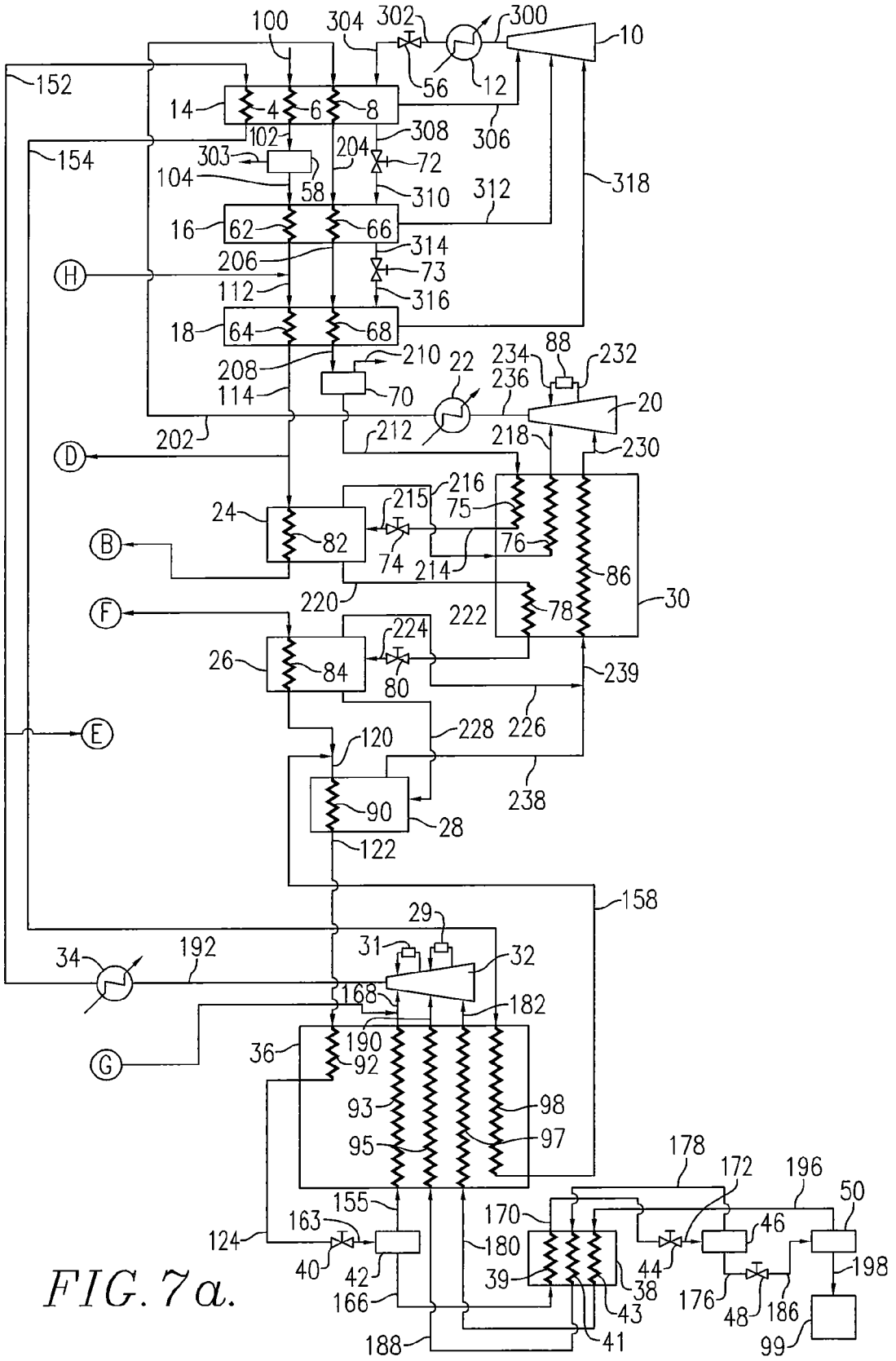
Figure 7B:
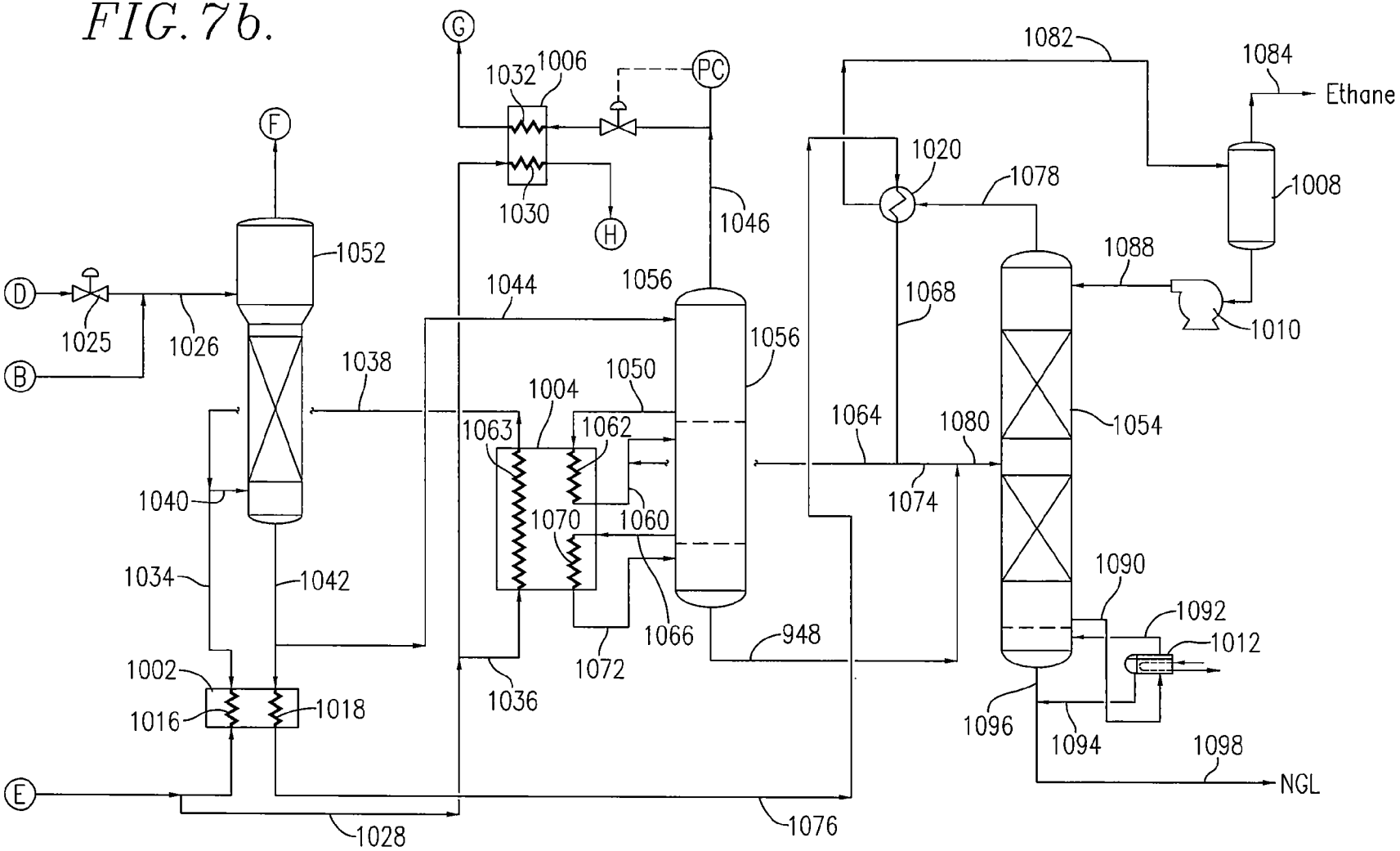

FIG. 6*b* is a flow diagram showing an integrated heavies removal/NGL recovery system connected to the LNG facility of FIG. 6*a* via lines H, D, B, F, E, I, and G;

FIG. 7*a* is a simplified flow diagram of a cascaded refrigeration process for producing LNG to meet significantly different specifications of two or more different markets with certain portions of the LNG facility connecting to lines H, D, B, F, E, and G being illustrated in FIG. 7*b*; and FIG. 7*b* is a flow diagram showing an integrated heavies removal/NGL recovery system connected to the LNG facility of FIG. 7*a* via lines H, D, B, F, E, and G.

DETAILED DESCRIPTION

The present invention can be implemented in a process/facility used to cool natural gas to its liquefaction temperature, thereby producing liquefied natural gas (LNG). The LNG process generally employs one or more refrigerants to extract heat from the natural gas and then reject the heat to the environment. In one embodiment, the LNG process employs a cascade-type refrigeration process that uses a plurality of multi-stage cooling cycles, each employing a different refrigerant composition, to sequentially cool the natural gas stream to lower and lower temperatures. In another embodiment, the LNG process is a mixed refrigerant process that employs at least one refrigerant mixture to cool the natural gas stream.

Natural gas can be delivered to the LNG process at an elevated pressure in the range of from about 500 to about 3,000 pounds per square in absolute (psia), about 500 to about 1,000 psia, or 600 to 800 psia. Depending largely upon the ambient temperature, the temperature of the natural gas delivered to the LNG process can generally be in the range of from about 0 to about 180° F., about 20 to about 150° F., or 60 to 125° F.

In one embodiment, the present invention can be implemented in an LNG process that employs cascade-type cooling followed by expansion-type cooling. In such a liquefaction process, the cascade-type cooling may be carried out at an elevated pressure (e.g., about 650 psia) by sequentially passing the natural gas stream through first, second, and third refrigeration cycles employing respective first, second, and third refrigerants. In one embodiment, the first and second refrigeration cycles are closed refrigeration cycles, while the third refrigeration cycle is an open refrigeration cycle that utilizes a portion of the processed natural gas as a source of the refrigerant. The third refrigeration cycle can include a multi-stage expansion cycle to provide additional cooling of the processed natural gas stream and reduce its pressure to near atmospheric pressure.

In the sequence of first, second, and third refrigeration cycles, the refrigerant having the highest boiling point can be utilized first, followed by a refrigerant having an intermediate boiling point, and finally by a refrigerant having the lowest boiling point. In one embodiment, the first refrigerant has a mid-boiling point within about 20, about 10, or 5° F. of the boiling point of pure propane at atmospheric pressure. The first refrigerant can contain predominately propane, propylene, or mixtures thereof. The first refrigerant can contain at least about 75 mole percent propane, at least 90 mole percent propane, or can consist essentially of propane. In one embodiment, the second refrigerant has a mid-boiling point within about 20, about 10, or 5° F. of the boiling point of pure ethylene at atmospheric pressure. The second refrigerant can contain predominately ethane, ethylene, or mixtures thereof. The second refrigerant can contain at least about 75 mole percent ethylene, at least 90 mole percent ethylene, or can consist essentially of ethylene. In one embodiment, the third refrigerant has a mid-boiling point within about 20, about 10, or 5° F. of the boiling point of pure methane at atmospheric pressure. The third refrigerant can contain at least about 50 mole percent methane, at least about 75 mole percent methane, at least 90 mole percent methane, or can consist essentially of methane. At least about 50, about 75, or 95 mole percent of the third refrigerant can originate from the processed natural gas stream.

The first refrigeration cycle can cool the natural gas in a plurality of cooling stages/steps (e.g., two to four cooling stages) by indirect heat exchange with the first refrigerant. Each indirect cooling stage of the refrigeration cycles can be carried out in a separate heat exchanger. In one embodiment, core-and-kettle heat exchangers are employed to facilitate indirect heat exchange in the first refrigeration cycle. After being cooled in the first refrigeration cycle, the temperature of the natural gas can be in the range of from about B45 to about B10° F., about B40 to about B15° F., or B20 to B30° F. A typical decrease in the natural gas temperature across the first refrigeration cycle may be in the range of from about 50 to about 210° F., about 75 to about 180° F., or 100 to 140° F.

The second refrigeration cycle can cool the natural gas in a plurality of cooling stages/steps (e.g., two to four cooling stages) by indirect heat exchange with the second refrigerant. In one embodiment, the indirect heat exchange cooling stages in the second refrigeration cycle can employ separate, core-and-kettle heat exchangers. Generally, the temperature drop across the second refrigeration cycle can be in the range of from about 50 to about 180° F., about 75 to about 150° F., or 100 to 120° F. In the final stage of the second refrigeration cycle, the processed natural gas stream can be condensed (i.e., liquefied) in major portion, preferably in its entirety, thereby producing a pressurized LNG-bearing stream. Generally, the process pressure at this location is only slightly lower than the pressure of the natural gas fed to the first stage of the first refrigeration cycle. After being cooled in the second refrigeration cycle, the temperature of the natural gas may be in the range of from about B205 to about B70°, about B175 to about B95° F., or B140 to B125° F.

The third refrigeration cycle can include both an indirect heat exchange cooling section and an expansion-type cooling section. To facilitate indirect heat exchange, the third refrigeration cycle can employ at least one brazed-aluminum plate-fin heat exchanger. The total amount of cooling provided by indirect heat exchange in the third refrigeration cycle can be in the range of from about 5 to about 60° F., about 7 to about 50° F., or 10 to 40° F.

The expansion-type cooling section of the third refrigeration cycle can further cool the pressurized LNG-bearing stream via sequential pressure reduction to approximately atmospheric pressure. Such expansion-type cooling can be accomplished by flashing the LNG-bearing stream to thereby produce a two-phase vapor-liquid stream. When the third refrigeration cycle is an open refrigeration cycle, the expanded two-phase stream can be subjected to vapor-liquid separation and at least a portion of the separated vapor phase (i.e., the flash gas) can be employed as the third refrigerant to help cool the processed natural gas stream. The expansion of the pressurized LNG-bearing stream to near atmospheric pressure can be accomplished by using a plurality of expansion steps (i.e., two to four expansion steps) where each expansion step is carried out using an expander. Suitable expanders include, for example, either Joule-Thomson expansion valves or hydraulic expanders. In one embodiment, the third refrigeration cycle can employ three sequential expansion cooling steps, wherein each expansion step can be followed by a separation of the gas-liquid product. Each expansion-type cooling step can cool the LNG-bearing stream in the range of from about 10 to about 60° F., about 15 to about 50° F., or to 35° F. The reduction in pressure across the first expansion step can be in the range of from about 80 to about 300 psia, about 130 to about 250 psia, or 175 to 195 psia. The pressure drop across the second expansion step can be in the range of from about 20 to about 110 psia, about 40 to about 90 psia, or 55 to 70 psia. The third expansion step can further reduce the pressure of the LNG-bearing stream by an amount in the range of from about 5 to about 50 psia, about 10 to about 40 psia, or 15 to 30 psia. The liquid fraction resulting from the final expansion stage is the final LNG product. Generally, the temperature of the final LNG product can be in the range of from about B200 to about B300° F., about B225 to about B275° F., or B240 to B260° F. The pressure of the final LNG product can be in the range of from about 0 to about 40 psia, about 10 to about 20 psia, or 12.5 to 17.5 psia.

The natural gas feed stream to the LNG process usually contains such quantities of $C_{2+}$ components so as to result in the formation of a $C_{2+}$ rich liquid in one or more of the cooling stages of the second refrigeration cycle. Generally, the sequential cooling of the natural gas in each cooling stage is controlled so as to remove as much of the $C_2$ and higher molecular weight hydrocarbons as possible from the gas, thereby producing a vapor stream predominating in methane and a liquid stream containing significant amounts of ethane and heavier components. This liquid can be further processed via gas-liquid separators employed at strategic locations downstream of the cooling stages. In one embodiment, one objective of the gas/liquid separators is to maximize the rejection of the $C_{5+}$ material to avoid freezing in downstream processing equipment. The gas/liquid separators may also be utilized to vary the amount of $C_2$ through $C_4$ components that remain in the natural gas product to affect certain characteristics of the finished LNG product. The exact configuration and operation of gas-liquid separators may be dependant on a number of parameters, such as the $C_{2+}$ composition of the natural gas feed stream, the desired BTU content (i.e., heating value) of the LNG product, the value of the $C_{2+}$ components for other applications, and other factors routinely considered by those skilled in the art of LNG plant and gas plant operation.

In one embodiment of the present invention, the LNG process can include natural gas liquids (NGL) integration within the LNG facility. One may significantly enhance the efficiency of LNG production and NGL recovery by integrating the two functions in one facility. In addition, the present invention can employ an integrated heavies removal/NGL recovery system that allows for prompt and economical variation in the BTU content (i.e., higher heating value (HHV)) of the LNG product stream so that various LNG markets can be served by one facility.

Accordingly, in one embodiment of the present invention, an LNG facility is provided that can be operated in different modes of operation to produce LNG and/or NGL products that meet different product specifications. For example, the LNG facility can be operated in a low-BTU mode to produce an LNG product having a low BTU content (e.g., 950-1060 BTU/SCF) or in a high-BTU mode to produce an LNG product having a high BTU content (e.g., 1070-1160 BTU/SCF). The LNG facility can also be operated in different modes of operation to produce different NGL products. For example, the LNG facility can be operated in a propane rejection mode to produce an NGL product having a low propane content (e.g., 0-20 mole percent) or in a propane recovery mode to produce an NGL product having a high propane content (e.g., 40-85 mole percent).

The average higher heating value (HHV) of LNG produced during different modes of operation of the LNG facility can differ from one another by at least about 10

BTU/SCF, at least about 20 BTU/SCF, or at least 50 BTU/SCF. Further, the average HHV of the LNG products produce by different modes of operation can vary by at least about 1 percent, at least about 3 percent, or at least 5 percent in the different modes of operation. In one embodiment, the difference in the average propane content of NGL produced during different modes of operation can be at least about 1 mole percent, at least about 2 mole percent, or at least 5 mole percent. The different modes of operation discussed herein are steady-state modes of operation, not operation during start-up or shut-down of the LNG facility. In one embodiment, each of the different steady-state modes of operation is carried out over a time period of at least one week, at least two weeks, or at least four weeks (as opposed to a lesser period of time that would typically be required for start-up or shut-down).

It is known that the HHV of produced LNG in conventional LNG plants may vary slightly over long periods of time do to changes in feed composition and/or changes in ambient conditions. However, in one embodiment, the present invention allows for relatively large and rapid adjustments in the HHV value of the LNG product and/or the propane content of the NGL product. To accomplish the relatively large and rapid adjustment in the HHV of the LNG product and/or the propane content of the NGL product, the LNG facility can be transition between the different modes of operation over a time period of less than 1 week, less than 3 days, less than 1 day, or less than 12 hours. In accordance with an embodiment of the present invention, the production of LNG does not cease during transitioning between different modes of operation. Rather, the LNG facility can be rapidly transitioned from one steady-state operating mode to another steady-state operating mode without requiring shut-down of the facility.

To transition the LNG facility from a first mode of operation to a second mode of operation, one or more operating parameters of the LNG facility can be adjusted. The operating parameter adjusted to transition the LNG facility between different modes of operation can be a non-feed operating parameter of the LNG facility (i.e., the transition between modes of operation is not caused by adjusting the composition of the feed to the LNG facility). For example, when the LNG facility includes a heavies removal/NGL recovery system that employs a distillation column to separate the processed natural gas stream into different components based on relative volatilities, the operating parameter adjusted to transition the LNG facility between different modes of operation can be an operating parameter of the distillation column. Such distillation column operating parameters may include, for example, column feed composition, column feed temperature, column overhead pressure, reflux stream flow rate, reflux stream composition, reflux stream temperature, stripping gas flow rate, stripping gas composition, and stripping gas temperature.

In one embodiment, the heavies removal/NGL recovery system of the LNG facility can employ a two column configuration. Such a system can include a first distillation column (e.g., a heavies removal column) and a second distillation column (e.g., a demethanizer, deethanizer, or depropanizer). Heavy liquids can be concentrated and removed from the bottom of the heavies removal column and can thereafter be routed to the second distillation column. The second column can be operated to stabilize the bottoms product and send lighter components overhead, eventually ending up in the LNG product. In accordance with one embodiment, the distillation columns are operated in a manner that produces only enough heavy material in the overhead to provide the LNG BTU content desired, as well as to stabilize the bottoms stream by removing undesired light components. In such a two column configuration, one or more operating parameters of one or both of the distillation columns can be adjusted to transition the LNG facility between different modes of operation. The various operating parameters that can be adjusted to transition the LNG facility between different modes of operation are discussed in detail below with reference to FIGS. 1-7.

LNG facilities capable of being operated in accordance with the present invention can have a variety of configurations. The flow schematics and apparatuses illustrated in FIGS. 1-7 represent several embodiments of inventive LNG facilities capable of efficiently supplying LNG products to two or more markets with different specifications. FIGS. 1*b*, 2*b*, 3*b*, 3*c*, 3*d*, 3*e*, 4*b*, 5*b*, 6*b*, and 7*b* represent various embodiments of the integrated heavies removal/NGL recovery system of the inventive LNG facility. Those skilled in the art will recognize that FIGS. 1-7 are schematics only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIGS. 1-7, Table 1, below, provides a summary of the numeric nomenclature that was employed to denote vessels, equipment, and conduits for the embodiments represented in FIGS. 1*a* through 7*b*.

TABLE 1

FIGS. 1 through 7 - SUMMARY OF NUMERIC NOMENCLATURE

| Reference # | Item(s) | Applicable Figures |
|---|---|---|
| 1-99 | Vessels and equipment | FIGS. 1a, 2a, 3a, 4a, 5a, 6a, 7a |
| 100-199 | Conduits containing mainly methane | FIGS. 1a, 2a, 3a, 4a, 5a, 6a, 7a |
| 200-299 | Conduits containing mainly ethane | FIGS. 1a, 2a, 3a, 4a, 5a, 6a, 7a |
| 300-399 | Conduits containing mainly propane | FIGS. 1a, 2a, 3a, 4a, 5a, 6a, 7a |
| 400-499 | Vessels, equipment, or conduits | FIG. 1b |
| 500-599 | Vessels, equipment, or conduits | FIG. 2b |
| 600-699 | Vessels, equipment, or conduits | FIG. 3, 3c, 3d, 3e |
| 700-799 | Vessels, equipment, or conduits | FIG. 4b |
| 800-899 | Vessels, equipment, or conduits | FIG. 5b |
| 900-999 | Vessels, equipment, or conduits | FIG. 6b |
| 1000-1099 | Vessels, equipment, or conduits | FIG. 7b |

The inventive LNG facilities illustrated in FIGS. 1-7 cool the natural gas to its liquefaction temperature using cascade-type cooling in combination with expansion-type cooling. The cascade-type cooling is carried out in three mechanical refrigeration cycles; a propane refrigeration cycle, followed by an ethylene refrigeration cycle, followed by a methane refrigeration cycle. The methane refrigeration cycle includes a heat exchange cooling section followed by an expansion-type cooling section. The LNG facilities of FIGS. 1-7 also include a heavies removal/NGL recovery system downstream of the propane refrigeration cycle for removing heavy hydrocarbon components from the processed natural gas and recovering the resulting NGL.

FIGS. 1*a* and 1*b* illustrate one embodiment of the inventive LNG facility. The system in FIG. 1*a* can sequentially cool natural gas to its liquefaction temperature via three mechanical refrigeration stages in combination with an expansion-type cooling section as described in detail below. FIG. 1*b* illustrates one embodiment of a heavies removal/NGL recovery system. Lines A, B, and C show how the heavies removal/NGL recovery system illustrated in FIG. 1*b* is integrated into the LNG facility of FIG. 1*a*. In accordance with one embodiment of the present invention, the LNG facility can be operated in such a way to maximize propane and heavier component recovery in the NGL product (also referred to herein as $AC_{3+}$ recovery@).

As illustrated in FIG. 1*a*, the main components of the propane refrigeration cycle include a propane compressor 10, a propane cooler 12, a high-stage propane chiller 14, an intermediate stage propane chiller 16, and a low-stage propane chiller 18. The main components of the ethylene refrigeration cycle include an ethylene compressor 20, an ethylene cooler 22, a high-stage ethylene chiller 24, an intermediate-stage ethylene chiller 26, a low-stage ethylene chiller/condenser 28, and an ethylene economizer 30. The main components of the indirect heat exchange portion of the methane refrigeration cycle include a methane compressor 32, a methane cooler 34, a main methane economizer 36, and a secondary methane economizer 38. The main components of the expansion-type cooling section of the methane refrigeration cycle include a high-stage methane expander 40, a high-stage methane flash drum 42, an intermediate-stage methane expander 44, an intermediate-stage methane flash drum 46, a low-stage methane expander 48, and a low-stage methane flash drum 50.

The operation of the LNG facility illustrate in FIG. 1*a* will now be described in more detail, beginning with the propane refrigeration cycle. Propane is compressed in multi-stage (e.g., three-stage) propane compressor 10 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 12 wherein it is cooled and liquefied via indirect heat exchange with an external fluid (e.g., air or water). A representative pressure and temperature of the liquefied propane refrigerant exiting propane cooler 12 is about 100° F. and about 190 psia. The stream from propane cooler 12 is passed through conduit 302 to a pressure reduction means, illustrated as expansion valve 56, wherein the pressure of the liquefied propane is reduced, thereby evaporating or flashing a portion thereof. The resulting two-phase product then flows through conduit 304 into high-stage propane chiller 14. High-stage propane chiller 14 cools the incoming gas streams, including the methane refrigerant recycle stream in conduit 152, the natural gas feed stream in conduit 100, and the ethylene refrigerant recycle stream in conduit 202 via indirect heat exchange means 4, 6, and 8, respectively. Cooled methane refrigerant gas exits high-stage propane chiller 14 through conduit 154 and is fed to main methane economizer 36, which will be discussed in greater detail in a subsequent section.

The cooled natural gas stream from high-stage propane chiller 14, also referred to herein as the methane-rich stream, flows via conduit 102 to a separation vessel 58 wherein gas and liquid phases are separated. The liquid phase, which can be rich in $C_{3+}$ components, is removed via conduit 303. The vapor phase is removed via conduit 104 and fed to intermediate-stage propane chiller 16 wherein the stream is cooled via an indirect heat exchange means 62. The resultant vapor/liquid stream is then routed to low-stage propane chiller 18 via conduit 112 wherein it is cooled by an indirect heat exchange means 64. The cooled methane-rich stream then flows through conduit 114 and enters high-stage ethylene chiller 24, which will be discussed further in a subsequent section.

The propane gas from high-stage propane chiller 14 is returned to the high-stage inlet port of propane compressor 10 via conduit 306. The residual liquid propane is passed via conduit 308 through a pressure reduction means, illustrated here as expansion valve 72, whereupon an additional portion of the liquefied propane is flashed or vaporized. The resulting cooled, two-phase stream enters intermediate-stage propane chiller 16 by means of conduit 310, thereby providing coolant for chiller 16. The vapor portion of the propane refrigerant exits intermediate-stage propane chiller 16 via conduit 312 and is fed to the intermediate-stage inlet port of propane compressor 10. The liquid portion flows from intermediate-stage propane chiller 16 through conduit 314 and is passed through a pressure-reduction means, illustrated here as expansion valve 73, whereupon a portion of the propane refrigerant stream is vaporized. The resulting vapor/liquid stream then enters low-stage propane chiller 18 via conduit 316, wherein it acts as a coolant. The vaporized propane refrigerant stream then exits low-stage propane chiller 18 via conduit 318 and is routed to the low-stage inlet port of propane compressor 10, whereupon it is compressed and recycled through the previously described propane refrigeration cycle.

As previously noted, the ethylene refrigerant stream in conduit 202 is cooled in high-stage propane chiller 14 via indirect heat exchange means 8. The cooled ethylene refrigerant stream then exits high-stage propane chiller 14 via conduit 204. The partially condensed stream enters intermediate-stage propane chiller 16, wherein it is further cooled by an indirect heat exchange means 66. The two-phase ethylene stream is then routed to low-stage propane chiller 18 by means of conduit 206 wherein the stream is totally condensed or condensed nearly in its entirety via indirect heat exchange means 68. The ethylene refrigerant stream is then fed via conduit 208 to a separation vessel 70 wherein the vapor portion, if present, is removed via conduit 210. The liquid ethylene refrigerant is then fed to the ethylene economizer 30 by means of conduit 212. The ethylene refrigerant at this location in the process is generally at a temperature of about B24° F. and a pressure of about 285 psia.

Turning now to the ethylene refrigeration cycle illustrated in FIG. 1*a*, the ethylene in conduit 212 enters ethylene economizer 30 and is cooled via an indirect heat exchange means 75. The sub-cooled liquid ethylene stream flows through conduit 214 to a pressure reduction means, illustrated here as expansion valve 74, whereupon a portion of the stream is flashed. The cooled, vapor/liquid stream then enters high-stage ethylene chiller 24 through conduit 215. The methane-rich stream exiting low-stage propane chiller 18 via conduit 114 enters the high-stage ethylene chiller 24, wherein it is further condensed via an indirect heat exchange means 82. The cooled methane-rich stream exits high-stage ethylene chiller 24 via conduit 116, whereupon a portion of the stream is routed via conduit B to the heavies removal/NGL recovery system of the process in FIG. 1*b*. Details of FIG. 1*b* will be discussed in a subsequent section. The remaining cooled methane-rich stream enters the intermediate-stage ethylene chiller 26.

The ethylene refrigerant vapor exits high-stage ethylene chiller 24 via conduit 216 and is routed back to the ethylene economizer 30, warmed via an indirect heat exchange means 76, and subsequently fed via conduit 218 to the high-stage inlet port of ethylene compressor 20. The liquid portion of the ethylene refrigerant stream exits high-stage ethylene chiller 24 via conduit 220 and is then further cooled in an indirect heat exchange means 78 of ethylene economizer 30. The resulting cooled ethylene stream exits ethylene economizer 30 via conduit 222 and passes through a pressure reduction means, illustrated here as expansion valve 80, whereupon a portion of the ethylene is flashed.

In a manner similar to high-stage ethylene chiller 24, the two-phase refrigerant stream enters intermediate-stage ethylene chiller 26 via conduit 224, wherein it acts as a coolant for the natural gas stream flowing through an indirect heat exchange means 84. The cooled methane-rich stream exiting intermediate-stage ethylene chiller 24 via conduit A is totally condensed or condensed nearly in its entirety. The stream is then routed to the heavies removal/NGL recovery system of the process in FIG. 1*b*, as discussed later.

The vapor and liquid portions of the ethylene refrigerant stream exit intermediate-stage ethylene chiller 26 via conduits 226 and 228, respectively. The gaseous stream in conduit 226 combines with a yet to be described ethylene vapor stream in conduit 238. The combined ethylene refrigerant stream enters ethylene economizer 30 via conduit 239, is warmed by an indirect heat exchange means 86, and is fed to the low-stage inlet port of ethylene compressor 20 via conduit 230. The effluent from the low-stage of the ethylene compressor 20 is routed to an inter-stage cooler 88, cooled, and returned to the high-stage port of the ethylene compressor 20. Preferably, the two compressor stages are a single module although they may each be a separate module, and the modules may be mechanically coupled to a common driver. The compressed ethylene product flows to ethylene cooler 22 via conduit 236 wherein it is cooled via indirect heat exchange with an external fluid (e.g., air or water). The resulting condensed ethylene stream is then introduced via conduit 202 to high-stage propane chiller 14 for additional cooling as previously noted.

The liquid portion of the ethylene refrigerant stream from intermediate-stage ethylene chiller 26 in conduit 228 enters low-stage ethylene chiller/condenser 28 and cools the methane-rich stream in conduit 120 via an indirect heat exchange means 90. The stream in conduit 120 is a combination of a heavies-depleted (i.e., light hydrocarbon rich) stream from the heavies removal/NGL recovery system of the process in conduit C and a recycled methane refrigerant stream in conduit 158. As noted previously, details of the heavies removal/NGL recovery system will be described in further detail below. The vaporized ethylene refrigerant from low-stage ethylene chiller/condenser 28 flows via conduit 238 and joins the ethylene vapors from the intermediate-stage ethylene chiller in conduit 226. The combined ethylene refrigerant vapor stream is then heated by the indirect heat exchange means 86 in the ethylene economizer 30 as described previously. The pressurized, LNG-bearing stream exiting the ethylene refrigeration cycle via conduit 122 can be at a temperature in the range of from about B200 to about B50° F., about B175 to about B100° F., or B150 to B125° F. and a pressure in the range from about 500 to about 700 psia, or 550 to 725 psia.

The pressurized, LNG-bearing stream is then routed to main methane economizer 36, wherein it is further cooled by an indirect heat exchange means 92. The stream exits through conduit 124 and enters the expansion-cooling section of the methane refrigeration cycle. The liquefied methane-rich stream is then passed through a pressure-reduction means, illustrated here as high-stage methane expander 40, whereupon a portion of the stream is vaporized. The resulting two-phase product enters high-stage methane flash drum 42 via conduit 163 and the gaseous and liquid phases are separated. The high-stage methane flash gas is transported to main methane economizer 36 via conduit 155 wherein it is heated via an indirect heat exchange means 93 and exits main methane economizer 36 via conduit 168 and enters the high-stage inlet port of methane compressor 32.

The liquid product from high-stage flash drum 42 enters secondary methane economizer 38 via conduit 166, wherein the stream is cooled via an indirect heat exchange means 39. The resulting cooled stream flows via conduit 170 to a pressure reduction means, illustrated here as intermediate-stage methane expander 44, wherein a portion of the liquefied methane stream is vaporized. The resulting two-phase stream in conduit 172 then enters intermediate-stage methane flash drum 46 wherein the liquid and vapor phases are separated and exit via conduits 176 and 178, respectively. The vapor portion enters secondary methane economizer 38, is heated by an indirect heat exchange means 41, and then reenters main methane economizer 36 via conduit 188. The stream is further heated by indirect heat exchange means 95 before being fed into the intermediate-stage inlet port of methane compressor 32 via conduit 190.

The liquid product from the bottom of intermediate-stage methane flash drum 46 then enters the final stage of the expansion cooling section as it is routed via conduit 176 through a pressure reduction means, illustrated here as low-stage methane expander 48, whereupon a portion of the liquid stream is vaporized. The cooled, mixed-phase product is routed via conduit 186 to low-stage methane flash drum 50, wherein the vapor and liquid portions are separated. The LNG product, which is at approximately atmospheric pressure, exits low-stage methane flash drum 50 via conduit 198 and is routed to storage, represented by LNG storage vessel 99.

As shown in FIG. 1*a*, the vapor stream exits low-stage methane flash drum 50 via conduit 196 and enters secondary methane economizer 38 wherein it is heated via an indirect heat exchange means 43. The stream then travels via conduit 180 to main methane economizer 36 wherein it is further cooled by an indirect heat exchange means 97. The vapor then enters the intermediate-stage inlet port of methane compressor 32 by means of conduit 182. The effluent from the low-stage of methane compressor 32 is routed to an inter-stage cooler 29, cooled, and returned to the intermediate-stage port of the methane compressor 32. Analogously, the intermediate-stage methane vapors are sent to an inter-stage cooler 31, cooled, and returned to the high-stage inlet port of methane compressor 32. Preferably, the three compressor stages are a single module, although they may each be a separate module and the modules may be mechanically coupled to a common driver. The resulting compressed methane product flows through conduit 192 to ethylene cooler 34 for indirect heat exchange with an external fluid (e.g., air or water). The product of cooler 34 is then introduced via conduit 152 to high-stage propane chiller 14 for additional cooling as previously discussed.

As previously noted, the methane refrigerant stream from high-stage propane chiller 14 in conduit 154 enters main methane economizer 36. The stream is then further cooled via indirect heat exchange means 98. The resulting methane refrigerant stream flows via conduit 158 and is combined with the heavies-depleted vapor stream in conduit C prior to entering low-stage ethylene chiller/condenser 28 via conduit 120, as previously discussed.

FIG. 1*b* illustrates one embodiment of the heavies removal/NGL recovery system of the inventive LNG facility. The main components of the system shown in FIG. 1*b* include a first distillation column 452, a second distillation column 454, and an economizing heat exchanger 402. In one embodiment, first distillation column 452 is operated as a demethanizer and second distillation column 454 is operated as a deethanizer. According to one embodiment of the present invention, the reflux stream to first distillation column 452 is comprised predominately of ethane.

The operation of the heavies removal/NGL recovery system illustrated in FIG. 1*b* will now be described in more detail. A partially vaporized, methane-rich stream in conduit B enters economizing heat exchanger 402, wherein the stream is further condensed via an indirect heat exchange means 404. The cooled stream exits economizing heat exchanger 402 via conduit 453 and combines with the stream in conduit A. The resulting stream then enters a first distillation column feed separation vessel 406 wherein vapor and liquid phases are separated. The vapor components are removed via conduit 455 and are then passed through a pressure reduction means, illustrated as a turbo expander 408, whereupon the resulting two-phase stream is fed to first distillation column 452 via conduit 456. The liquid phase exiting first distillation column feed separation vessel 406 via conduit 458 passes through a pressure reduction means, illustrated here as expansion valve 410, wherein a portion of the stream is vaporized. The resulting vapor/liquid stream is introduced into first distillation column 452 via conduit 460.

A predominantly methane overhead product exits first distillation column 452 via conduit 462 and passes through a pressure control means 412, which is preferably a flow control valve, and reenters the liquefaction stage via conduit C.

As shown in FIG. 1*b*, a side stream is drawn via conduit 464 from first distillation column 452 and is routed to economizing heat exchanger 402 wherein the liquid is heated (reboiled) by an indirect heat exchange means 414. The resulting, partially vaporized stream is transferred via conduit 466 to first distillation column 452, wherein it is employed as a stripping gas. The stripping gas imparts energy to and vaporizes a portion of the heavier hydrocarbon components in the column that would typically remain in the liquid product in the absence of the stripping gas. Stripping gas allows more precise control of the separation of light and heavy components in first distillation column 452 that ultimately leads to the ability to methodically adjust the characteristics of the final LNG product, such as, for example, the heating value.

As shown in FIG. 1*b*, the bottoms liquid product from first distillation column 452 exits through conduit 468 and passes through a pressure reduction means, illustrated by an expansion valve 416, wherein a portion of the stream is vaporized. The resulting two-phase stream from the expansion valve 416 is then fed to second distillation column 454 via conduit 470. A stream is drawn from a port between the overhead and bottom column ports of second distillation column 454 via conduit 472 and routed to heater 418, wherein the stream is partially vaporized (reboiled) by indirect heat exchange with an external fluid (e.g., steam or other heat transfer fluid). The resultant vapor stream is returned via conduit 474 to second distillation column 454 as a stripping gas. The resulting liquid stream is removed from indirect heat exchanger 418 via conduit 476 and is thereafter combined with the liquid bottom product from second distillation column 454 in conduit 478. This combined stream is the recovered NGL product and is routed to storage or further processing via conduit 480.

The overhead vapor product of second distillation column 454 flows via conduit 482 through a pressure control means 420, which is preferably a flow control valve, to economizing heat exchanger 402 via conduit 483. The stream is cooled and partially condensed via an indirect heat exchange means 422. This two-phase stream is then passed to a second distillation column reflux separation vessel 424 via conduit 486 wherein the liquid and vapor phases are separated. The liquid stream is refluxed back to second distillation column 454 by means of conduit 488. The vapor stream passes through conduit 490 and into economizing heat exchanger 402, wherein the vapor is cooled and partially condensed via an indirect heat exchange means 426. The stream exits economizing heat exchanger 402 via conduit 492 and is routed to cooler 428, wherein it is further cooled and condensed, preferably condensed in its entirety, via indirect heat exchange. Cooler 428 can be an external cooler, or can be a pass in one of the chillers (e.g., ethylene chiller 28) illustrated in FIG. 1*a*. The resulting condensed stream enters first distillation column separation vessel 430 via conduit 494, and is thereafter transferred to a reflux pump 432 via conduit 496. The sub-cooled liquid stream is then discharged from reflux pump 432 via conduit 498 as reflux to first distillation column 452.

Generally, the characteristics of the final LNG product can be altered to meet the different specifications of two or more markets by manipulating one or more key process parameters, such as, for example, the temperature or pressure of process vessels or the temperature, pressure, flow, or composition of streams associated with the process vessels. Such associated streams include, for example, a column reflux stream, a column stripping gas stream, and a column feed stream. In order to affect changes to process variables, the configuration of related process equipment may be modified. For example, the number, arrangement, operation, and/or type of equipment utilized can be changed to achieve the desired result.

In accordance with one embodiment of the present invention, the higher heating value (HHV) of the LNG product can be adjusted by varying one or more operating parameters of the system illustrated in FIG. 1*b*. For example, in order to produce LNG of lower heating value the following adjustments could be made to the operating parameters of columns 452 and/or 454: (1) lower the amount of $C_{2+}$ components contained in feed stream(s) 456 and/or 460 to first distillation column 452; (2) lower the temperature of feed streams 456,460 to first distillation column 454; (3) increase the flow rate of reflux stream 498 to first distillation column 452; (4) lower the temperature of reflux stream 498 to first distillation column 452; (5) increase the amount of $C_{2+}$ components contained in reflux stream 498 to first distillation column 452; (6) lower the flow rate of stripping gas stream 466 to first distillation column 452; (7) lower the temperature of stripping gas stream 466 to first distillation column 452; (8) increase the overhead pressure of first distillation column 452; (9) lower the amount of $C_{3+}$ components contained in feed stream 470 to second distillation column 454; (10) lower the temperature of feed stream 470 to second distillation column 454; (11) increase the flow rate of reflux stream 488 to second distillation column 454; (12) lower the temperature of reflux stream 488 to second distillation column 454; (13) lower the flow rate of reboil stream 474 to second distillation column 454; (14) lower the temperature of reboil stream 474 to second distillation column 454; and (15) increase the overhead pressure of second distillation column 454.

There are a number of ways to affect the adjustments of items (1)-(15) listed above. For example, the amount of $C_{2+}$ components contained in feed stream(s) 456 and/or 460 to first distillation column 452 can be adjusted using additional upstream separation techniques. For example, the temperature of feed streams 456,460 to first distillation column 452 can be lowered at least about 1° F. or at least 3° F. by adjusting flow rates in heat exchanger 402 or other upstream heat exchangers. For example, the flow rate of reflux stream 498 to first distillation column 452 can be increased by providing more cooling of overhead stream 149 of second distillation column 454 in heat exchanger 402 (pass 422). For example, the temperature of reflux stream 498 to first distillation column 452 can be lowered by at least 5° F. by providing more cooling in heat exchanger 402 (pass 426) or heat exchanger 428. For example, the amount of $C_{2+}$ components contained in reflux stream 498 to first distillation column 452 can be increased by at least 10 mole percent by altering the operation of second distillation column 454. For example, the flow rate of stripping gas stream 466 to first distillation column 452 can be lowered via control valves (not shown). For example, the temperature of stripping gas stream 466 to first distillation column 452 can be lowered at least 5° F. by providing less heating in heat exchanger 402 (pass 414). For example, the overhead pressure of first distillation column can be increased by restricting overhead flow in line 462 via valve 412. For example, the amount of $C_{3+}$ components contained in feed stream 470 to second distillation column 454 can be lowered by including additional separation means or combining a methane-rich stream between columns 452 and 454. For example, the temperature of feed stream 470 to second distillation column 454 can be lowered by providing additional cooling to the stream in conduit 470. For example, the flow rate of reflux stream 488 to second distillation column 454 can be increased by providing more cooling to overhead stream 482 of second distillation column 454 in heat exchanger 402 (pass 422). For example, the temperature of reflux stream 488 to second distillation column 454 can be lowered by providing more cooling to overhead stream 482 of second distillation column 454 in heat exchanger 402 (pass 422). For example, the flow rate of reboil stream 472 to second distillation column 454 can be lowered by decreasing the amount of heat transfer taking place in the reboiler of second distillation column 454. For example, the temperature of reboil stream 472 to second distillation column 454 can be lowered by decreasing the amount of heat transfer taking place in the reboiler of second distillation column 454. For example, the overhead pressure of second distillation column 454 can be increased by restricting overhead flow in line 482 via valve 420.

It should be understood that the HHV of the LNG product from the LNG facility of FIGS. 1*a* and 1*b* can be increased by performing the converse of one or more of the above-described operations.

Table 2, below, provides a summary of broad and narrow ranges for various properties of selected streams from FIG. 1*b*.

TABLE 2

FIG. 1b - STREAM PROPERTIES

| | Temperature (° F.) | | Pressure (psia) | | $C_{2+}$ (mole %) | |
|---|---|---|---|---|---|---|
| Stream Number | Broad Range | Narrow Range | Broad Range | Narrow Range | Broad Range | Narrow Range |
| 456 | −125 to −50 | −115 to −65 | 300-1,200 | 400-800 | 2-30 | 4-15 |
| 460 | −110 to −25 | −80 to −40 | 300-1,200 | 400-800 | 5-50 | 10-40 |
| 466 | −50 to 100 | 0 to 50 | 300-1,200 | 400-800 | 30-90 | 50-80 |
| 498 | −180 to −80 | −160 to −110 | 300-1,200 | 400-800 | 20-80 | 40-70 |
| 462 | −140 to −60 | −110 to −75 | 300-1,200 | 400-800 | 1-25 | 2-15 |
| 468 | −50 to 120 | −10 to 50 | 200-1,000 | 300-600 | 30-90 | 50-80 |
| 470 | −60 to 100 | −20 to 45 | 200-1,000 | 300-600 | 30-90 | 50-80 |
| 474 | 0 to 200 | 30 to 150 | 200-1,000 | 300-600 | 40-99 | 75-95 |
| 488 | −75 to 75 | −25 to 25 | 200-1,000 | 300-600 | 30-95 | 40-80 |
| 482 | −50 to 120 | −10 to 50 | 200-1,000 | 300-600 | 20-80 | 40-70 |
| 478 | −100 to 60 | −60 to 10 | 200-1,000 | 300-600 | 40-99 | 75-95 |

FIGS. 2*a* and 2*b* illustrate another embodiment of the inventive LNG facility capable of efficiently supplying LNG products meeting significantly different product specifications. FIG. 2*b* illustrates one embodiment of the heavies removal/NGL recovery system of the present invention. Lines B, F, N, O, and P show how the liquefaction section shown in FIG. 2*a* is integrated with the heavies removal/NGL recovery system of LNG facility illustrated in FIG. 2*b*. In accordance with one embodiment of the present invention, the LNG facility may be configured and operated in such a way as to maximize $C_{3+}$ recovery in the NGL product.

The main components of the propane and ethylene refrigeration cycles of the liquefaction stage represented by FIG. 2*a* are numbered the same as those listed previously for FIG. 1*a*. In addition, the methane refrigeration cycle in FIG. 2*a* employs a recycle compressor 31.

The operation of the LNG facility illustrated in FIG. 2*a*, as it differs from that previously detailed with respect to FIG. 1*a*, will now be described in detail. In FIG. 2*a*, the cooled, methane-rich stream exits low-stage propane chiller 18 via conduit 114. The stream then enters high-stage ethylene chiller 24, wherein it is further cooled via indirect heat exchange means 82. The resulting methane-rich stream exits intermediate-stage ethylene chiller 24 via conduit B and is routed to the heavies removal/NGL recovery system illustrated in FIG. 2*b*, whereupon it undergoes additional processing, as described in detail in a subsequent section.

The methane-rich stream then enters intermediate-stage ethylene chiller 26 in FIG. 2*a* from the yet-to-be-described heavies removal/NGL recovery system of FIG. 2*b* via conduit F. The stream is then further cooled in intermediate-stage ethylene chiller 26 via indirect heat exchange means 84. The sub-cooled liquid stream exits intermediate-stage ethylene chiller 26 and combines with the liquid methane refrigerant exiting main methane economizer 36 via conduit 158. The combined stream is routed via conduit 120 into low-stage ethylene chiller/condenser 28, wherein it is cooled by indirect heat exchange means 90. In addition to cooling the methane-rich stream, low-stage ethylene chiller 28 also acts as a condenser via indirect heat exchange means 91 for a yet-to-be-discussed stream from conduit N in FIG. 2*b*. The pressurized, LNG-bearing stream in FIG. 2*a* exits low-stage ethylene chiller/condenser 28 via conduit 122 and proceeds through the indirect heat exchange and expansion cooling stages of the methane refrigeration cycle as detailed previously. The resulting liquid from the final-stage expansion is the LNG product.

In the methane refrigeration cycle of FIG. 2*a*, a yet-to-be-discussed stream from the heavies removal/NGL recovery system enters main methane economizer 36 via conduit P, wherein the stream is cooled via an indirect heat exchange means 81. The resulting stream is then routed via conduit 191 to recycle compressor 31, whereupon the compressed effluent travels via conduit 193 and combines with the methane refrigerant recycle stream in conduit 154 from the outlet of high-stage propane chiller 14. The composite stream then enters main methane economizer 36, wherein it is cooled via indirect heat exchange means 98. The stream is then recycled via conduit 158 and joins the methane-rich stream exiting intermediate-stage ethylene chiller 26, as previously noted. The total stream then enters low-stage ethylene chiller/condenser 28 via conduit 120 and proceeds through the process steps as previously described with respect to FIG. 1*a*.

Turning now to FIG. 2*b*, another embodiment of the heavies removal/NGL recovery system of the inventive LNG facility is illustrated. The main components of the system in FIG. 2*b* include first distillation column 552, second distillation column 554, economizing heat exchanger 502, expander 504, and feed surge vessel 506. According to one embodiment of the present invention, the first distillation column 552 can be operated as a demethanizer and the second distillation column 554 may be operated as a deethanizer. In one embodiment of the inventive LNG facility, first distillation column 552 can be refluxed with a predominantly ethane stream.

The operation of the heavies removal/NGL recovery system of the inventive LNG facility presented in FIG. 2*b* will now be described in detail. The partially condensed effluent from high-stage ethylene chiller 24 flows into conduit B in FIG. 2*a*, as noted previously, and then enters feed surge vessel 506 in FIG. 2*b*, wherein the vapor and liquid are separated. The vapor portion enters first distillation column feed expander 504 via conduit 520, wherein a portion of the stream is condensed. The cooled, vapor/liquid stream is fed via conduit 524 proximate to the lower portion of first distillation column 552. The vapor product from the overhead port of first distillation column 552 in FIG. 2*b* is routed via conduit F into the inlet of intermediate stage ethylene chiller 26 in FIG. 2*a*, as noted previously. The predominantly methane stream is subsequently cooled and will ultimately become the final LNG product.

The liquid stream exits feed surge vessel 506 via conduit 522, whereupon it combines with the liquid product from the bottom port of first distillation column 552 in conduit 526. The composite stream travels via conduit 528 to economizing heat exchanger 502, wherein it is heated via an indirect heat exchange means 514. The resulting stream feeds second distillation column 554 via conduit 530. The liquid product from the bottom port of second distillation column 554 is the final NGL product. In FIG. 2*b*, the NGL product is routed to further processing or storage via conduit 550.

A stream is drawn from a side port of second distillation column 554 via conduit 540. The stream enters heater 512, wherein it is heated (reboiled) via indirect heat exchange with an external fluid (e.g., steam or heat transfer fluid). The resulting vapor is returned to second distillation column 554 via conduit 542, wherein it is employed as a stripping gas. The vapor stream from the overhead port of second distillation column 554 travels by way of conduit 532 to economizing heat exchanger 502, wherein it is partially condensed via indirect heat exchange means 516. The resulting, partially liquefied stream is routed via conduit 534 to the second distillation column overhead surge vessel 508, wherein the vapor and liquid are separated.

The vapor stream exits overhead surge vessel 508 via conduit P in FIG. 2*b* and enters main methane economizer 36 in FIG. 2*a*. The stream is cooled, compressed, and recycled back to the inlet of low-stage ethylene chiller/condenser 28, as previously discussed. As shown in FIG. 2*b*, the liquid phase from second distillation column separation vessel 508 enters the suction of reflux pump 510 via conduit 536. A portion of the reflux pump 510 discharge is sent to the second distillation column 554 as reflux via conduit 538. The remainder of the stream is routed via conduit N in FIG. 2*b* to the inlet of low-stage ethylene chiller/condenser 28 in FIG. 2*a*, as previously noted. As shown in FIG. 2*a*, a portion of the stream enters low-stage ethylene chiller/condenser 28, wherein it is cooled via an indirect heat exchange means 91. The cooled stream exits low-stage ethylene chiller via conduit O. For the purpose of controlling the temperature of the stream in conduit O, a portion of the liquid in conduit N can bypass low-stage ethylene chiller via conduit 121 as controlled by valve 125. For example, to decrease the temperature of the stream in conduit O, valve 125 can be closed to decrease the flow through conduit 121, thereby allowing more of the stream to be cooled by low-stage ethylene chiller/condenser 28. The resulting stream in conduit O is then sent to first distillation column 552 as reflux.

According to one embodiment of the present invention, the heating value of the LNG product can be adjusted by varying one or more operating parameters of the system illustrated in FIG. 2*b*. For example, in order to produce LNG of lower heating value, one or more of the following adjustments could be made to the operating parameters of distillation columns 552 and/or 554: (1) lower the temperature of feed stream 524 to first distillation column 552; (2) increase the flow rate of reflux stream O to first distillation column 552; (3) lower the temperature of reflux stream O to first distillation column 552; (4) increase the overhead pressure of first distillation column 552; (5) lower the temperature of feed stream 530 to second distillation column 554; (6) increase the flow rate of reflux stream 538 to second distillation column 554; (7) lower the temperature of reflux stream 538 to second distillation column 554; (8) lower the flow rate of stripping gas 542 to second distillation column 554; (9) lower the temperature of stripping gas 542 to second distillation column 554; and (10) increase the overhead pressure of second distillation column 554.

As detailed previously with respect to FIG. 1*b*, several methods, including those well-known to one skilled in the art of distillation and LNG plant operation, exist to affect the adjustments of items (1)-(10). For example, in accordance with this embodiment, the temperature of the reflux stream O to first distillation column 552 can be reduced by closing valve 125 to force more flow through low-stage ethylene chiller/condenser 28 to be cooled, as previously discussed.

Similarly to FIGS. 1*a* and 1*b*, it should be understood that the heating value of the LNG product from the LNG facility of FIGS. 2*a* and 2*b* can be increased by performing the converse of one or more of the above-described operations.

A further embodiment of the inventive LNG facility capable of efficiently supplying LNG product to meet significantly different specifications of two or more markets is illustrated in FIG. 3*a*. FIGS. 3*b* through 3*e* represent several embodiments of the heavies removal/NGL recovery system of the present invention. FIG. 3*b* represents one embodiment of the heavies removal/NGL recovery system of the LNG facility employing a reflux compressor. FIG. 3*c* illustrates another embodiment of the inventive heavies removal/NGL recovery system that utilizes a reflux pump. FIG. 3*d* shows a further embodiment of the heavies removal/NGL recovery system, which employs an expander to cool and partially condense distillation column feed. Yet another embodiment illustrated in FIG. 3*e* seeks to maximize $C_{3+}$ recovery (98+%) in the NGL product by incorporating heavier hydrocarbons (i.e., $C_{4's}$ and $C_{5's}$) into the column reflux. Lines D, J, B, F, E, L, K, M, and G show how the systems presented in FIGS. 3*b* through 3*e* are integrated into the LNG facility of FIG. 3*a*.

The main components of the liquefaction step of the inventive LNG facility shown in FIG. 3*a* are the same as those described for the embodiment described with respect to FIG. 1*a*. The operation of the facility illustrated in FIG. 3*a*, as it differs from the operation of FIG. 1*a* discussed in detail previously, will now be presented.

The partially vaporized, methane-rich stream exits low-stage propane chiller 18 via conduit 114, whereupon a portion of the stream is routed via conduit D to the heavies removal/NGL recovery system of the LNG facility illustrated in FIG. 3*b*, 3*c*, 3*d*, or 3*e*. Several alternate embodiments of the inventive heavies removal/NGL recovery system are illustrated in FIGS. 3*b* through 3*e*; each will be discussed in detail in subsequent sections. Prior to entering high-stage ethylene chiller 24, a stream from the heavies removal/NGL recovery system in conduit J from FIG. 3*b*, 3*c*, 3*d*, or 3*e* combines with the methane-rich stream in conduit 114. In FIG. 3*a*, the combined stream enters high-stage ethylene chiller 24, wherein it is further cooled via indirect heat exchange means 82. The resulting stream is then routed to the heavies removal/NGL recovery system in FIG. 3*b*, 3*c*, 3*d*, or 3*e* via conduit B. The stream undergoes further processing, as described in detail later, and is then returned via conduit F to intermediate-stage ethylene chiller 26, wherein it is cooled via an indirect heat exchange means 84. The resulting stream exits intermediate-stage ethylene chiller 26, whereupon it combines with the methane refrigerant recycle stream in conduit 158 in a manner similar to the one detailed in the description of FIG. 1*a*.

According to FIG. 3*a*, the combined stream flows via conduit 120 into low-stage ethylene chiller/condenser 28, wherein it is cooled via indirect heat exchange means 90. In addition to cooling the methane-rich stream, low-stage ethylene chiller in FIG. 3*a* also acts as a condenser for a yet-to-be-discussed stream from conduit N in the heavies removal/NGL recovery systems represented by FIG. 3*b*, 3*c*, 3*d*, or 3*e*. The resulting methane-rich stream is at least partially condensed, or condensed in its entirety, and exits low-stage ethylene chiller/condenser 28 in FIG. 3*a*, whereupon it combines with a stream from the heavies removal/NGL recovery system in conduit M. The composite stream enters main methane economizer 36 and proceeds through the indirect heat exchange and expansion cooling segments of the methane refrigeration cycle, as detailed previously with respect to FIG. 1*a*. Analogously, the liquid portion of the final expansion stage is the LNG product.

In the methane refrigeration cycle of FIG. 3*a* an additional stream in conduit G from the yet-to-be-discussed heavies removal/NGL recovery system combines with the effluent from main methane economizer 36 in conduit 168, prior to entering the high-stage inlet port of methane compressor 32. The resulting compressed methane refrigerant stream is routed via conduit 192 to methane cooler 34, wherein the stream is cooled via indirect heat exchange with an external fluid (e.g., air or water). Prior to entering high-stage propane chiller 14, a portion of the methane refrigerant is routed to the heavies removal/NGL recovery system in FIG. 3*b*, 3*c*, 3*d*, or 3*e* via conduit E. The remainder of the methane refrigerant stream in FIG. 3*a* is routed via conduit 152 to high-stage propane chiller 14, as described previously.

Turning now to FIG. 3*b*, one embodiment of the heavies removal/NGL recovery system of the LNG facility will now be described. The main components of FIG. 3*b* include a first distillation column 652, a second distillation column 654, an economizing heat exchanger 602, and a reflux compressor 608. In accordance with one embodiment of the present invention, first distillation column 652 can be refluxed with a stream predominately comprised of ethane.

The operation of the inventive system illustrated in FIG. 3*b* will now be described in more detail. As noted previously, the streams in conduits D and B originate in the liquefaction system illustrated in FIG. 3*a*. Conduit D contains a portion of the partially condensed methane-rich stream exiting low-stage propane chiller 18 as shown in FIG. 3*a*. The stream in conduit B represents the cooled effluent of the high-stage ethylene chiller 24, represented in FIG. 3*a*. As shown in FIG. 3*b*, the streams in conduits B and D combine prior to feeding first distillation column 652. In one embodiment, the stream in conduit B is cooler, and the flow in conduit D can be increased via valve 625 as needed to adjust the temperature of the feed to first distillation column in conduit 626. The vapor product from the overhead port of first distillation column 652 in FIG. 3*b* exits via conduit F and enters intermediate-stage ethylene chiller 26 in FIG. 3*a*, as previously noted, to ultimately become the final LNG product.

Two side streams via conduits 628 and 630 are drawn from first distillation column 652. The stream in conduit 628 enters economizing heat exchanger 602, wherein it is heated (reboiled) and at least partially vaporized via an indirect heat exchange means 618. The side stream in conduit 630 acts as a coolant for a yet-to-be-discussed overhead vapor product from second distillation column 654 in a condenser 620. The resulting, at least partially, and preferably totally, vaporized streams, combine in conduit 636 prior to reentering first distillation column 652. These primarily vaporized streams then act as a stripping gas in first distillation column 652.

The liquid product from the bottom port of first distillation column 652 feeds second distillation column 654 via conduit 638. A side stream is drawn from second distillation column 654 via conduit 666 and passes through heater 612, wherein the stream is reboiled (heated) via indirect heat exchange with an external fluid (e.g., steam or other heat transfer fluid). A portion of the stream vaporizes and is routed from heater 612 via conduit 668 to second distillation column 654, wherein it is employed as stripping gas. The remaining liquid flows from heat exchanger 612 through conduit 672 and combines with the liquid product from the bottom port of second distillation column 654 in conduit 670. The composite stream is the final NGL product, which can be, in one embodiment, predominantly made up of propane and heavier components. The NGL stream is routed via conduit 676 to further processing and/or storage.

The vapor product from the overhead port of second distillation column 654 exits via conduit 640 and is thereafter condensed via condenser 620 by indirect heat exchange with the side stream from first distillation column 652 in conduit 630 as described previously. The resulting cooled, at least partially condensed stream flows via conduit 642 to second distillation column separation vessel 604, wherein the vapor and liquid phases are separated. The liquid portion flows via conduit 662 to the suction of a reflux pump 606. The stream then discharges into conduit 664 and is employed as a first distillation column 652 reflux stream.

The vapor stream exits second distillation column separation vessel 604 via conduit 634. One portion of the vapor stream can be routed by way of conduit 644 for use in other applications or as fuel. Another fraction of the vapor product can be routed via conduit G to the high-stage inlet port of methane compressor 32 in FIG. 3*a*, as previously described.

According to FIG. 3*b*, the remaining vapor product is routed via conduit 646 to the inlet suction port of a reflux compressor 608. The compressed vapor travels via conduit 648 and enters economizing heat exchanger 602, wherein the vapor is cooled via an indirect heat exchange means 616. The resulting stream exits economizing heat exchanger 602 via conduit K and enters low-stage ethylene chiller/condenser 28 in FIG. 3*a*, wherein the vapor is further cooled and condensed via indirect heat exchange means 91. The partially condensed, preferably totally condensed, stream exits low-stage ethylene chiller 26 via conduit L and is sent to first distillation column 652 in FIG. 6*b* as reflux. A portion of the reflux stream may be routed via conduit M to combine with the pressurized, LNG bearing stream in conduit 122, in FIG. 3*a*. As discussed previously, this composite stream will eventually become the finished LNG product.

As mentioned previously, prior to entering high-stage propane chiller 14, a portion of the methane refrigerant stream in conduit 152 is routed via conduit E to the heavies removal/NGL recovery system in FIG. 3*b*, 3*c*, 3*d*, or 3*e*. In FIG. 3*b*, the stream in conduit E enters economizing heat exchanger 602, wherein it is cooled via an indirect heat transfer means 614. The resulting stream flows via conduit J and combines with the effluent of low-stage propane chiller 18 in conduit 114 as discussed earlier.

Referring now to FIG. 3*c*, another embodiment of the heavies removal/NGL recovery system of the LNG facility is illustrated. The main components and the operation of the system in FIG. 3*c* are the same as those described in FIG. 3*b*. However, the embodiment shown in FIG. 3*c* utilizes a reflux pump 609 instead of the reflux compressor used in FIG. 3*b*. The cooled stream in conduit L exits low-stage ethylene chiller in FIG. 3*a* and then enters the suction of reflux pump 609 in FIG. 3*c*. The stream is discharged into conduit 660, whereupon a portion can be routed to the pressurized, LNG-bearing stream in conduit 122 in FIG. 3*a* via conduit M, as discussed previously. According to FIG. 3*c*, the remaining portion of the stream returns in conduit 660 to first distillation column 652 as reflux.

Referring now to FIG. 3*d*, yet another embodiment of the heavies removal/NGL recovery system of the LNG facility is illustrated. The main components of the system illustrated in FIG. 3*d* are the same as those described in FIG. 3*b*. However, FIG. 3*d* employs a separator vessel 611 and an expander 613 for the feed to first distillation column 652.

The operation of the system illustrated in FIG. 3*d* will now be described in detail, as it differs from the operation of the system described with respect to FIG. 3*b*. According to FIG. 3*d*, the streams in conduits B and D enter from FIG. 3*a*. In FIG. 3*d*, the streams in conduit 626 is routed to separator vessel 611, wherein the vapor and liquid portions are separated and exit via conduits 660 and 662, respectively. The liquid stream then directly feeds first distillation column 652. The vapor portion from separation vessel 611 enters expander 613, whereupon the pressure is reduced and a portion of the stream is condensed. The resulting vapor/liquid stream is then fed to first distillation column 652 via conduit 664. The remainder of the process operates in a like manner as described according to the embodiment illustrated in FIG. 3*b*.

Still another embodiment of the heavies removal/NGL recovery system of the LNG facility is illustrated in FIG. 3*e*. The main components of FIG. 3*e* are the same as those listed in the embodiment illustrated in FIG. 3*b*. In addition, the system illustrated in FIG. 3*e* can be operated in a like manner to the heavies removal/NGL recovery system shown in FIG. 3*b*. However, FIG. 3*e* employs an additional reflux stream comprising heavier hydrocarbon components (e.g., $C_{4's}$ and $C_{5's}$) to achieve a high propane recovery in the NGL product.

The operation of the system illustrated in FIG. 3*e* will now be described in detail, as it differs from the system presented in FIG. 3*b*. The vapor from second distillation column 654 in conduit 646 is compressed by recycle compressor 608. The resulting stream flows via conduit 648, whereupon it combines with an additional reflux stream comprising heavier hydrocarbon components, preferably $C_{4's}$ and $C_{5's}$, in conduit 680. The composite stream enters economizing heat exchanger 602, wherein it is cooled via indirect heat exchange means 616. The cooled stream travels via conduit K to the low-stage ethylene chiller/condenser 28 in FIG. 3*a*. As previously described in FIGS. 3*a* and 3*b*, the stream is further cooled and condensed prior to returning to first distillation column 652 as reflux.

According to one embodiment of the present invention, the HHV of the LNG product can be adjusted by varying one or more operating parameters of the system illustrated in FIGS. 3*b* through 3*e*. For example, in order to produce LNG of lower heating value, one or more of the following adjustments could be made to the operating parameters of distillation columns 652 and/or 654: (1) lower temperature of feed stream 626 to first distillation column 652; (2) lower the temperature of reflux stream L to first distillation column 652; (3) lower the temperature of stripping gas 636 to first distillation column 652; (4) increase the flow of reflux stream L to first distillation column 652; (5) lower the temperature of feed stream 638 to second distillation column 654; (6) lower the temperature of reflux stream 664 to second distillation column 654; (7) lower the temperature of stripping gas 668 to second distillation column 654; (8) increase the flow of reflux stream 664 to second distillation column 654; (9) increase the flow of overhead vapor stream of second distillation column 654 to fuel via conduit 644. As detailed previously with respect to FIG. 1*b*, several methods, including those well known to one skilled in the art of LNG facilities and distillation, exist to affect the adjustments of items (1)-(9).

Similarly to FIGS. 1*a* and 1*b*, it should be understood that the heating value of the LNG product from the LNG facility of FIGS. 3*a*, 3*b*, 3*c*, 3*d*, and 3*e* can be increased by performing the converse of one or more of the above-described operations.

Still another embodiment of the inventive LNG facility is illustrated in FIG. 4*a*. FIG. 4*b* illustrates a further embodiment of the heavies removal/NGL recovery system of the LNG facility. Lines D, B, F, E, I, and G demonstrate how the system illustrated in FIG. 4*b* is integrated into the inventive LNG facility shown in FIG. 4*a*. According to one embodiment of the present invention, the LNG facility can be operated in such a way as to maximize $C_{3+}$ recovery in the NGL product. In accordance with another embodiment, the facility can be operated to maximize $C_{5+}$ recovery in the NGL product.

Referring now to FIG. 4*a*, the main components of the inventive LNG facility are the same as those listed previously with respect to FIG. 1*a*. The operation of the system presented in FIG. 4*a*, as it differs from the system described in reference to FIG. 1*a*, will now be described in detail.

According to FIG. 4*a*, the methane-rich stream exits low-stage propane chiller 18 via conduit 114, whereupon a portion is routed via conduit D to the heavies removal/NGL recovery system illustrated to FIG. 4*b*. The details of the heavies removal/NGL recovery system shown in FIG. 4*b* will be discussed in detail in a subsequent section. The remaining methane-rich stream in FIG. 4*a* enters high-stage ethylene chiller 24, wherein it is further cooled via indirect heat exchange means 82. The resulting stream exits high-stage ethylene chiller 24 via conduit B and flows to the heavies removal/NGL recovery system in FIG. 4*b*. After additional processing, to be discussed later, the methane-rich stream returns to FIG. 4*a* via conduit F and enters intermediate-stage ethylene chiller 26, wherein the stream is cooled via indirect heat exchange means 84. The resulting stream subsequently flows via conduit 120 to the low-stage ethylene chiller/condenser 28, is cooled via indirect heat exchange means 90, and exits low-stage ethylene chiller/condenser 28 via conduit 122. The pressurized, LNG-bearing stream in conduit 122 is then routed through the indirect heat exchange and expansion-type cooling portions of the methane refrigeration cycle as discussed previously, in regard to FIG. 1*a*. As noted previously, the liquid resulting after the final stage of expansive cooling is the final LNG product.

In the methane refrigeration cycle of FIG. 4*a*, a yet-to-be-discussed stream from the heavies removal/NGL recovery system illustrated in FIG. 4*b* in conduit G combines with the methane refrigerant stream in FIG. 4*a* exiting main methane economizer 36 via conduit 168 prior to being injected into the high-stage inlet port of methane compressor 32. The compressed methane refrigerant stream is routed via conduit 192 to methane cooler 34, wherein the stream is cooled via indirect heat exchange with an external fluid (e.g., air or water). A portion of the stream exiting methane cooler 34 via conduit 152 is then routed to FIG. 4*b* via conduit E for further processing. The remaining refrigerant enters high-stage propane chiller 14, wherein it is further cooled by indirect heat exchange means 4, as previously noted. The resulting stream flows through conduit 154 and enters main methane economizer 36, wherein the methane refrigerant stream is further cooled via indirect heat exchange means 98. The resulting stream exits main methane economizer 36 via conduit 158 and enters low-stage ethylene chiller/condenser 28. Subsequently, the methane refrigerant stream is further cooled via indirect heat exchange means 91, which utilizes the ethylene refrigerant described in detail in FIG. 1*a* as a coolant. The resulting stream in FIG. 4*a* exits low-stage ethylene chiller/condenser 28 via conduit I and is routed to the heavies removal/NGL recovery system illustrated in FIG. 4*b*.

Turning now to FIG. 4*b*, a still further embodiment of the heavies removal/NGL recovery system of the LNG facility is shown. The main components of the system illustrated in FIG. 4*b* include a first distillation column 752, a second distillation column 754, and an economizing heat exchanger 702. In accordance with one embodiment of the present inventive LNG facility, first distillation column 752 can be operated as a demethanizer and second distillation column 754 can be operated as a deethanizer. According to one embodiment of the present invention, first distillation column 752 is refluxed with a stream comprising primarily of methane.

The operation of the system illustrated in FIG. 4*b* will now be described in more detail. As previously mentioned, in FIG. 4*a*, conduits B and D exit low-stage propane chiller 18 and high-stage ethylene chiller 24, respectively. In FIG. 4*b*, the streams in conduits B and D combine prior to entering first distillation column 752 via conduit 726. As described according to FIG. 2*b*, the relative flows of streams B and D can be adjusted via valve 725 to affect a specified temperature of the feed stream in conduit 726. The vapor product from the overhead port of first distillation column 752 exits via conduit F, whereupon it is routed to the inlet of high-stage ethylene chiller 24 in FIG. 4*a*. As previously described, the methane-rich stream exiting high-stage ethylene chiller 24 in FIG. 4*a* is subsequently cooled to become the final LNG product.

As previously noted in FIG. 4*a*, a portion of the methane refrigerant recycle stream is routed to FIG. 4*b* via conduit E. The stream enters economizing heat exchanger 702, wherein the stream is heated via indirect heat exchange means 716. The resulting, at least partially vaporized stream enters first distillation column 752 via conduit 736, wherein the heated vapor is employed as a stripping gas.

As also previously noted in FIG. 4*a*, the methane refrigerant recycle stream in conduit 158 is cooled in the low-stage ethylene chiller/condenser 28 via indirect heat exchange means 93. The resulting stream exits the low-stage ethylene chiller/condenser 28 via conduit I. This cooled, primarily methane-rich stream is routed to FIG. 4*b*, wherein it serves as reflux for first distillation column 752.

According to FIG. 4*b*, the liquid product from the bottom port of first distillation column 752 exits via conduit 788, whereupon the stream splits into conduits 730 and 732. The stream in conduit 732 enters economizing heat exchanger 702, wherein the stream is heated via indirect heat exchange means 718. The resulting warmed stream exits economizing heat exchanger 702 via conduit 738. A portion of the stream in conduit 738 may be routed through conduit 744 via valve 743 in order to bypass condenser 720. The conduit 744 bypass around condenser 720 can be one mechanism for second distillation column feed and/or overhead vapor product temperature control.

Referring now to the remaining portion of second distillation column bottom liquid product in conduit 730 in FIG. 4*b*, the stream bypasses economizing heat exchanger 702, passes through valve 737, and recombines with the warmed stream in conduit 747. The composite stream enters condenser 720 via conduit 740. The temperature of the stream in conduit 740 can be controlled by adjusting the flow rate through conduit 730 by opening or closing valve 737. For example, to increase the temperature of the stream in conduit 740, one can further close valve 737, thereby forcing a larger portion of flow through economizing heat exchanger 702 to be heated, therefore increasing the temperature of the composite stream entering condenser 720. Condenser 720 acts an indirect heat exchange means to cool a yet-to-be discussed stream by using stream 740 as a coolant. The coolant exits condenser 720 via conduit 742. Thereafter, the streams in conduits 742 and 744 combine, and the composite stream in conduit 746 feeds second distillation column 754.

A side stream is drawn from second distillation column 754 via conduit 766 and sent to a heater 712, wherein the stream is heated (reboiled) via indirect heat exchange with an external fluid (e.g., steam or heat transfer fluid). The vaporized portion of the stream is returned to second distillation column 754 via conduit 768, wherein it is employed as a stripping gas. The resulting liquid portion exits second distillation column reboiler 712 via conduit 727, whereupon it combines with the liquid product from the bottom port of second distillation column 754 in conduit 770. The resulting composite stream in conduit 776 is the final NGL product. According to one embodiment, the NGL product can be rich in propane and heavier components. According to another embodiment of the present invention, second distillation column 754 may be operated in such a way as to maximize $C_{5+}$ component recovery in the final NGL product. By maximizing the $C_{5+}$ component recovery in the NGL product, an LNG product with a relatively higher HHV can be produced.

The vapor product from the overhead port of second distillation column 754 exits via conduit 778, whereupon the stream is cooled and at least partially condensed by condenser 720. The resulting stream exits condenser 720 via conduit 780 and enters second distillation column separation vessel 704, wherein the vapor and liquid phases are separated. The vapor portion, comprised primarily of ethane, is routed via conduit G to FIG. 4*a*, whereupon it combines with the stream in conduit 168 prior to being injected into the high-stage inlet port of the methane compressor, as discussed previously. The liquid phase exits second distillation column separation vessel 704 via conduit 762 and enters the suction of a reflux pump 706. The liquid is refluxed to second distillation column 754 via conduit 764.

According to one embodiment of the present invention, the heating values of the LNG product can be adjusted by varying one or more operating parameters of the system illustrated in FIG. 4*b*. For example, in order to produce LNG of lower heating value, one or more of the following adjustments could be made to the operating parameters of distillation columns 752 and/or 754: (1) lower the temperature of feed stream 726 to first distillation column 752; (2) lower the flow of stripping gas stream 736 to first distillation column 752; (3) increase the flow of reflux stream I to first distillation column 752; (4) lower the temperature of reflux stream 764 to second distillation column 754; and (5) lower the temperature of stripping gas stream 768 to second distillation column 754. As discussed previously with reference to FIG. 1*b*, several methods, including those well known to a skilled artisan, exist to affect the adjustments listed in items (1)-(5) above.

Similarly to FIGS. 1*a* and 1*b*, it should be understood that the heating value of the LNG product from the LNG facility of FIGS. 4*a* and 4*b* can be increased by performing the converse of one or more of the above-described operations.

FIG. 5*a* represents still another embodiment of the LNG facility capable of efficiently supplying an LNG product with significantly different product specifications to meet the needs of two or more markets. FIG. 5*b* illustrates a still further embodiment of the heavies removal/NGL recovery system of the inventive LNG facility. Lines D, B, F, E, and G illustrate how the system shown in FIG. 5*b* is integrated with the LNG facility of FIG. 5*a*. According to one embodiment of the present invention, the LNG facility can be operated in such a way as to maximize the recovery of propane and heavier components in the NGL product. In accordance with another embodiment, the facility can be operated to maximize $C_{5+}$ recovery in the NGL product.

The main components of the system in FIG. 5*a* are the same as those listed in FIG. 1*a*. The operation of FIG. 5*a*, as it differs from FIG. 1*a*, will now be explained in detail. The methane-rich stream exits the low-stage propane chiller 18 via conduit 114, whereupon a portion of the stream is routed via conduit D for further processing in the heavies removal/NGL recovery system shown in FIG. 5*b*. The details of the system illustrated in FIG. 5*b* will be described in a later section.

The remaining methane-rich stream enters high-stage ethylene chiller 24, wherein it is cooled via indirect heat exchange means 82. The resulting stream is routed via conduit B to the heavies removal/NGL recovery system in FIG. 5*b*. After additional processing, to be discussed later, the methane-rich stream returns to FIG. 5*a* via conduit F, whereupon it enters intermediate-stage ethylene chiller 26 and is cooled via indirect heat exchange means 84. The resulting stream flows via conduit 119 and combines with the methane refrigerant recycle stream in conduit 158. The composite stream flows via conduit 120 into low-stage ethylene chiller/condenser 28, wherein it is further cooled via indirect heat exchange means 90. The resulting pressurized, LNG-bearing stream exits low-stage ethylene chiller/condenser 28 via conduit 122 and is routed to main methane economizer 36. The pressurized, LNG-bearing stream then continues through the indirect heat exchange and expansion cooling stages of the methane refrigeration cycle, as previously described in reference to FIG. 1*a*. Similarly to FIG. 1*a*, the resultant liquid from the final expansion stage is the final LNG product in FIG. 5*a*.

In the methane refrigeration cycle illustrated in FIG. 5*a*, a yet-to-be-discussed stream in conduit G originates in the heavies removal/NGL recovery system illustrated in FIG. 5*b* and enters FIG. 5*a*, wherein it combines with the methane refrigerant stream in conduit 168 upstream of the high-stage inlet port of methane compressor 32. The compressed composite stream is routed via conduit 192 to methane cooler 34, wherein the stream is cooled via indirect heat exchange with an external fluid (e.g., air or water). A portion of the resulting stream is routed to FIG. 5*b* via conduit E for further processing. The remainder of the refrigerant stream flows via conduit 152 to high-stage propane chiller 18 and is processed as described previously with respect to FIG. 1*a*.

Turning now to FIG. 5*b*, still another embodiment of the heavies removal/NGL recovery system of the LNG facility is shown. The main components of the system shown in FIG. 5*b* include a first distillation column 852, a second distillation column 854, and an economizing heat exchanger 802. In accordance with one embodiment of the LNG facility, first distillation column 852 can be operated as a demethanizer and second distillation column 854 can be operated as a deethanizer. In another embodiment, first distillation column 852 can be operated as a demethanizer and second distillation column 854 can be operated as a debutanizer. According to one embodiment of the present invention, first distillation column 852 is not refluxed.

The operation of the system illustrated in FIG. 5*b* is analogous to the operation as described with respect to the heavies removal/NGL recovery system illustrated in FIG. 4*b*. However, first distillation column 852 in FIG. 5*b* can be operated without a reflux stream. The lines and components in FIG. 5*b* are numerically labeled with a value that is 100 greater than the corresponding lines in FIG. 4*b*. Lettered lines (e.g., B, D, E, F, G) are the same in FIGS. 5*b* and 4*b*. The function and operation of the corresponding lines and components in FIG. 5*b* are analogous to those described previously in reference to FIG. 4*b*. For example, the function and operation of stripping gas stream 836 to first distillation column 852 in FIG. 5*b* directly corresponds to the function and operation of stripping gas stream 736 to first distillation column 752 in FIG. 4*b*.

In accordance to one embodiment of the present invention, the heating values of the LNG product can be adjusted by varying one or more operating parameters of the system illustrated in FIG. 5*b*. For example, in order to produce LNG of lower heating value, one or more of the following adjustments could be made to the operating parameters of distillation columns 852 and/or 854: (1) lower the temperature of feed stream 826 to first distillation column 852; (2) lower the flow of stripping gas stream 836 to first distillation column 852; (3) increase the flow of reflux stream I to first distillation column 852; (4) lower the temperature of reflux stream 864 to second distillation column 854; and (5) lower the temperature of stripping gas stream 868 to second distillation column 854. As discussed previously with reference to FIG. 1*b*, several methods, including those well known to one skilled in the art, exist to affect the adjustments listed in items (1)-(5) above.

Similarly to FIGS. 1*a* and 1*b*, it should be understood that the heating value of the LNG product from the LNG facility of FIGS. 5*a* and 5*b* can be increased by performing the converse of one or more of the above-described operations.

Yet another embodiment of the inventive facility capable of supplying an LNG product with significantly different specifications meeting the needs of two or more different markets is presented in FIG. 6*a*. FIG. 6*b* illustrates yet another embodiment of the heavies removal/NGL recovery system of the present invention. Lines H, D, B, F, E, I, and G illustrate how the system shown in FIG. 6*b* is integrated with the LNG facility of FIG. 6*a*. According to one embodiment of the present invention, the LNG facility can be operated to maximize the recovery of ethane and heavier components in the final NGL product.

The main components of the system in FIG. 6*a* are the same as those listed in FIG. 1*a*. The operation of FIG. 6*a*, as it differs from the operation of the system in FIG. 1*a* as described previously, will now be explained in detail. The methane-rich stream exits intermediate-stage propane chiller 16 via conduit 112, whereupon it combines with a yet-to-be discussed stream in conduit H from FIG. 6*b*. The operation of the heavies removal/NGL recovery system illustrated in FIG. 6*b* will be discussed in detail shortly. The composite stream enters low-stage propane chiller 18, wherein the stream is cooled via indirect heat exchange means 64. The resulting, cooled stream exits low-stage propane chiller 18 via conduit 114, whereupon a portion of the stream is routed via conduit D for further processing in the heavies removal/NGL recovery system shown in FIG. 6*b*, to be discussed in detail later.

The remaining methane-rich stream in FIG. 6*a* enters high-stage ethylene chiller 24, wherein it is further cooled via indirect heat exchange means 82. The resulting stream exits high-stage ethylene chiller 24 via conduit B and flows to the heavies removal/NGL recovery system in FIG. 6*b*. After additional processing, to be discussed later, the methane-rich stream returns to FIG. 6*a* via conduit F and enters intermediate-stage ethylene chiller 26, wherein the stream is cooled via indirect heat exchange means 84. The resulting stream subsequently flows via conduit 120 to the low-stage ethylene chiller/condenser 28, is cooled via indirect heat exchange means 90, and exits low-stage ethylene chiller/condenser 28 via conduit 122. The pressurized, LNG-bearing stream in conduit 122 is then routed through the indirect heat exchange and expansion-type cooling portions of the methane refrigeration cycle as discussed previously, regarding FIG. 1*a*. As noted previously, the liquid resulting after the last stage of expansive cooling is the final LNG product.

In the methane refrigeration cycle of FIG. 6*a*, a yet-to-be-discussed stream from the heavies removal/NGL recovery system illustrated in FIG. 6*b* in conduit G combines with the methane refrigerant stream in conduit 168 in FIG. 6*a* exiting main methane economizer 36 prior to being injected into the high-stage inlet port of methane compressor 32. The compressed methane refrigerant stream is routed via conduit 192 to methane cooler 34, wherein the stream is cooled via indirect heat exchange with an external fluid (e.g., air or water). The resulting stream exits methane cooler 34, whereupon a portion of the recycled methane refrigerant stream is routed to FIG. 6*b* via conduit E for further processing. The remaining methane refrigerant stream in conduit 152 in FIG. 6*a* enters high-stage propane chiller 18, wherein it is further cooled by indirect heat exchange means 4, as previously noted. The resulting stream then flows through conduit 154 and enters main methane economizer 36, wherein the methane refrigerant stream is further cooled via indirect heat exchange means 98. The resulting stream exits main methane economizer 36 via conduit 158 and enters low-stage ethylene chiller/condenser 28. Subsequently, the methane refrigerant stream is further cooled via indirect heat exchange means 91, which utilizes the ethylene refrigerant described in detail in FIG. 1*a* as a coolant. The resulting stream in FIG. 6*a* exits low-stage ethylene chiller/condenser 28 via conduit I and is routed to the heavies removal/NGL recovery system illustrated in FIG. 6*b*.

Turning now to FIG. 6*b*, a further embodiment of the heavies removal/NGL recovery system of the LNG facility is shown. The main components of the system illustrated in FIG. 6*b* include a first distillation column 952, a second distillation column 954, a main economizing heat exchanger 904, a first distillation column economizing heat exchanger 902, an intermediate stage separator heat exchanger 906, and an intermediate-stage flash drum 956. In one embodiment of the present invention, first distillation column 952 can be operated as a demethanizer and the second distillation column 954 can be operated as a deethanizer. According to one embodiment, first distillation column 952 is refluxed by a stream comprised primarily of methane.

The operation of the system illustrated in FIG. 6*b* will now be described in detail, beginning with first distillation column 952. Streams in conduits B and D enter from the outlets of low-stage propane chiller 18 and high-stage ethylene chiller 24, respectively, as discussed previously with respect to FIG. 6*a*. According to FIG. 6*b*, the two streams combine in conduit 926 prior to entering first distillation column 952. The flow of relatively warmer stream D can be manipulated via valve 925 to maintain a desired temperature to first distillation column feed 926. The vapor product in FIG. 6*b* from the overhead port of first distillation column 952 exits via conduit F and enters intermediate-stage ethylene chiller 26, as discussed previously in FIG. 6*a*. This stream will ultimately become the finished LNG product.

A portion of the methane recycle stream in FIG. 6*a* is routed to FIG. 6*b* via conduit E. Thereafter, the stream in conduit E splits into several conduits. One portion of the stream in conduit E flows through conduit 928, whereupon a further portion of the stream is routed by way of conduit 936 to the main economizing heat exchanger 904, wherein the stream is cooled via an indirect heat exchange means 963. The resultant stream exits main economizing heat exchanger 904 via conduit 938 and combines with a yet-to-be-discussed stream in conduit 934. Referring back to conduit 928, the remaining portion of the stream enters intermediate stage separator economizing heat exchanger 906, wherein the stream is cooled via an indirect heat exchange means 930. The resulting, cooled stream exits via conduit H and is routed to the inlet of low-stage propane chiller 18 in FIG. 6*a*, as previously noted. In FIG. 6*b*, the remainder of the stream in conduit E enters the first distillation column economizing heat exchanger 902, wherein the stream is cooled via an indirect heat exchanges means 916. The resulting stream exits first distillation column economizing heat exchanger 902 via conduit 934, whereupon it combines with the cooled stream in conduit 938, as noted previously. The composite stream flows via conduit 940 into first distillation column 952, wherein it is employed as a stripping gas. The stream in conduit I enters from the outlet of intermediate-stage ethylene chiller 26 in FIG. 6*a*, as previously noted. According to FIG. 4*b*, this primarily methane stream is refluxed back to first distillation column 952 in FIG. 6*b*.

The liquid product from the bottom port of first distillation column 952 exits via conduit 942. A portion of the stream is then routed via conduit 944 to intermediate-stage separator 956, wherein the vapor and liquid phases are separated. The vapor phase exits via conduit 946 and is routed to intermediate stage separator economizing heat exchanger 906, wherein the stream is warmed via an indirect heat exchange means 932. The resulting stream exits intermediate stage separator economizing heat exchanger 906 and is routed via conduit G to the high-stage inlet port of methane compressor 32 in FIG. 6*a* as previously described.

According to FIG. 6*b*, a liquid stream exits intermediate-stage separation vessel 956 via conduit 948 and combines with a yet-to-be-discussed stream in conduit 974. Two side streams are removed from intermediate stage flash drum 956. One side stream is drawn from intermediate separation vessel 956 via conduit 950. The side stream flows to main economizing heat exchanger 904, wherein it is heated (reboiled) via an indirect heat exchange means 962. The resulting stream combines with a yet-to-be-discussed stream in conduit 964 and returns to the intermediate-stage separation vessel 956 via conduit 960. Another side stream is drawn from intermediate separation vessel 956 and routed to main economizing heat exchanger 904 via conduit 966. The stream is then heated and at least partially vaporized via an indirect heat exchange means 970. The resulting stream exits main economizing heat exchanger 904 via conduit 972 and is returned to intermediate-stage separation vessel 956.

Turning now to the remainder of the bottom liquid product from first distillation column 952 in conduit 942, the stream enters first distillation column economizing heat exchanger 902, wherein it is cooled via indirect heat exchange means 918. The resulting cooled liquid is travels via conduit 976 to a condenser 920, wherein the stream in conduit 976 acts as a coolant for a yet to be discussed stream in conduit 978. After exiting condenser 920, the resulting, heated stream in conduit 968 divides into two streams in conduits 964 and 974. The portion of the stream in conduit 964 combines with the stream exiting main economizing heat exchanger 904 in conduit 960 prior to entering intermediate-stage separation vessel 956, as discussed previously. The portion of the heated stream in conduit 974 combines with the liquid phase exiting intermediate separation vessel 956 via conduit 948. The resulting composite stream enters second distillation column 954 via conduit 980.

The vapor product from the overhead port of second distillation column 954 exits via conduit 978 and enters condenser 920, wherein the stream is condensed via indirect heat exchange with the liquid stream from the bottom port of first distillation column 952 in conduit 976, as discussed previously. The at least partially condensed stream travels via conduit 982 to second distillation column separation vessel 908, wherein the vapor and liquid phases are separated. The predominantly ethane-rich vapor phase exits second distillation column separation vessel 908 and is routed for further processing and/or storage via conduit 984. The liquid phase leaves second distillation column separation vessel 908 via conduit 986 and enters the suction of a reflux pump 910. Reflux pump 910 discharges the stream as reflux to second distillation column 954 via conduit 988.

A side stream is drawn from second distillation column 954 via conduit 990. The stream is routed to a heater 912, wherein it is heated (reboiled) via indirect heat exchange with an external fluid (e.g., steam or heat transfer fluid). The vaporized portion of the stream is returned to second distillation column 954 via conduit 992, wherein it is employed as a stripping gas. The resulting liquid portion exits second distillation column reboiler 912 via conduit 994, whereupon it combines with the liquid product from the bottom port of second distillation column 954 in conduit 996. The resulting composite stream is the final NGL product. The final NGL product is comprised of ethane and heavier components and is routed to storage and/or further processing via conduit 998.

In accordance to one embodiment of the present invention, the heating values of the LNG product can be adjusted by varying one or more operating parameters of the system illustrated in FIG. 6*b*. For example, in order to produce LNG of lower heating value, one or more of the following adjustments could be made to the operating parameters of distillation columns 952 and/or 954: (1) lower the temperature of feed stream 26 to first distillation column 952; (2) lower the flow of stripping gas stream 940 to first distillation column 952; and (3) increase the flow of reflux stream I to first distillation column 952. As discussed previously with reference to FIG. 1*b*, several methods, including those well known to one skilled in the art, exist to affect the adjustments listed in items (1)-(3) above.

Similarly to FIGS. 1*a* and 1*b*, it should be understood that the heating value of the LNG product from the LNG facility of FIGS. 6*a* and 6*b* can be increased by performing the converse of one or more of the above-described operations.

Still another embodiment of the inventive LNG facility is illustrated in FIGS. 7*a* and 7*b*. Another embodiment of the heavies removal/NGL recovery system of the facility is illustrated in FIG. 7*b*. Lines H, D, B, F, E, and G illustrate how the system shown in FIG. 7*b* is integrated with the LNG facility in FIG. 7*a*. According to one embodiment of the present invention, the LNG facility can be operated to maximize $C_{2+}$ recovery in the final NGL product.

The main components of the system in FIG. 7*a* are the same as those listed in FIG. 1*a*. The operation of FIG. 7*a*, as it differs from the operation of the system previously described with respect to FIG. 1*a*, will now be explained in detail. The methane-rich stream exits intermediate-stage propane chiller 16 via conduit 112, whereupon it combines with a yet-to-be discussed stream in conduit H from FIG. 7*b*. The operation of the system illustrated in FIG. 7*b* will be discussed in detail shortly. The composite stream enters low-stage propane chiller 18, wherein the stream is cooled via indirect heat exchange means 64. The resulting, cooled stream exits low-stage propane chiller 18 via conduit 114, whereupon a portion of the stream is routed via conduit D for further processing in the heavies removal/NGL recovery system shown in FIG. 7*b*, to be discussed in detail later.

The remaining methane-rich stream enters high-stage ethylene chiller 24, wherein it is cooled via indirect heat exchange means 82. The resulting stream is routed via conduit B to the heavies removal/NGL recovery system in FIG. 7*b*. After additional processing, to be discussed later, the methane-rich stream returns to FIG. 7*a* via conduit F, whereupon it enters intermediate-stage ethylene chiller 26 and is cooled via indirect heat exchange means 84. The resulting stream flows via conduit 119 and combines with the methane refrigerant recycle stream in conduit 158. The composite stream flows via conduit 120 into low-stage ethylene chiller/condenser 28, wherein it is further cooled via indirect heat exchange means 90. The resulting pressurized, LNG-bearing stream exits low-stage ethylene chiller/condenser 28 via conduit 122 and is routed to main methane economizer 36. The pressurized, LNG-bearing stream then continues through the indirect heat exchange and expansion cooling stages of the methane refrigeration cycle, as previously described in reference to FIG. 1*a*. Similarly to FIG. 1*a*, the resultant liquid from the last expansion stage is the final LNG product in FIG. 7*a*.

In the methane refrigeration cycle illustrated in FIG. 7*a*, a yet-to-be-discussed stream in conduit G originates in the heavies removal/NGL recovery system illustrated in FIG. 7*b* and enters FIG. 7*a*, wherein it combines with the methane refrigerant stream in conduit 168 upstream of the high-stage inlet port of methane compressor 32. The compressed composite stream is routed via conduit 192 to methane cooler 34, wherein the stream is cooled via indirect heat exchange with an external fluid (e.g., air or water). A portion of the resulting stream is routed to FIG. 7*b* via conduit E for further processing. The remainder of the refrigerant stream flows via conduit 152 to high-stage propane chiller 14 and is processed as described previously with respect to FIG. 1*a*.

Turning now to FIG. 7*b*, the heavies removal/NGL recovery system of the inventive LNG facility is shown. The main components of the system shown in FIG. 7*b* include a first distillation column 1052, a second distillation column 1054, a main economizing heat exchanger 1004, a first distillation column economizing heat exchanger 1002, an intermediate stage separator heat exchanger 1006, and an intermediate-stage flash drum 1056. In one embodiment of the present invention, first distillation column 1052 can be operated as a demethanizer and the second distillation column 1054 can be operated as a deethanizer. According to one embodiment, first distillation column 1052 is not refluxed.

The operation of the system illustrated in FIG. 7*b* is analogous to the operation as described with respect to the heavies removal/NGL recovery system illustrated in FIG. 6*b*, except first distillation column 1052 in FIG. 7*b* has no reflux stream. The lines and components in FIG. 7*b* are numerically labeled with a value that is 100 greater than the corresponding lines in FIG. 6*b*. Lettered lines (e.g., B, D, E, F, G, H) are the same in FIGS. 7*b* and 6*b*. The function and operation of the corresponding lines and components in FIG. 7*b* are analogous to those described previously in reference to FIG. 6*b*. For example, stripping gas stream 1040 to first distillation column 1052 in FIG. 7*b* directly corresponds to the function and operation of stripping gas stream 940 to first distillation column 952 in FIG. 6*b*.

In accordance to one embodiment of the present invention, the heating values of the LNG product can be adjusted by varying one or more operating parameters of the system illustrated in FIG. 7*b*. For example, in order to produce LNG of lower heating value, one or more of the following adjustments could be made to the operating parameters of distillation columns 1052 and/or 1054: (1) lower the temperature of feed stream 26 to first distillation column 1052; (2) lower the flow of stripping gas stream 1040 to first distillation column 1052; and/or (3) increase the flow of reflux stream 1088 to second distillation column 1054. As discussed previously with reference to FIG. 1*b*, several methods, including those well known to one skilled in the art, exist to affect the adjustments listed in items (1)-(3) above.

Similarly to FIGS. 1*a* and 1*b*, it should be understood that the heating value of the LNG product from the LNG facility of FIGS. 7*a* and 7*b* can be increased by performing the converse of one or more of the above-described operations.

In one embodiment of the present invention, the LNG production systems illustrated in FIGS. 1-7 are simulated on a computer using conventional process simulation software. Examples of suitable simulation software include HYSYSJ from Hyprotech, Aspen Plus7 from Aspen Technology, Inc., and PRO/II7 from Simulation Sciences Inc.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting Agreater than 10@ (with no upper bounds) and a claim reciting Aless than 100@ (with no lower bounds).

The present description uses specific numerical values to quantify certain parameters relating to the invention, where the specific numerical values are not expressly part of a numerical range. It should be understood that each specific numerical value provided herein is to be construed as providing literal support for a broad, intermediate, and narrow range. The broad range associated with each specific numerical value is the numerical value plus and minus 60 percent of the numerical value, rounded to two significant digits. The intermediate range associated with each specific numerical value is the numerical value plus and minus 30 percent of the numerical value, rounded to two significant digits. The narrow range associated with each specific numerical value is the numerical value plus and minus 15 percent of the numerical value, rounded to two significant digits. For example, if the specification describes a specific temperature of 62° F., such a description provides literal support for a broad numerical range of 25° F. to 99° F. (62° F.+/−37° F.), an intermediate numerical range of 43° F. to 81° F. (62° F.+/−19° F.), and a narrow numerical range of 53° F. to 71° F. (62° F.+/−9° F.). These broad, intermediate, and narrow numerical ranges should be applied not only to the specific values, but should also be applied to differences between these specific values. Thus, if the specification describes a first pressure of 110 psia and a second pressure of 48 psia (a difference of 62 psi), the broad, intermediate, and narrow ranges for the pressure difference between these two streams would be 25 to 99 psi, 43 to 81 psi, and 53 to 71 psi, respectively.

Definitions

As used herein, the term Anatural gas@ means a stream containing at least 65 mole percent methane, with the balance being ethane, higher hydrocarbons, nitrogen, carbon dioxide, and/or a minor amount of other contaminants such as mercury, hydrogen sulfide, and mercaptan.

As used herein, the term Amixed refrigerant@ means a refrigerant containing a plurality of different components, where no single component makes up more than 75 mole percent of the refrigerant.

As used herein, the term Apure component refrigerant@ means a refrigerant that is not a mixed refrigerant.

As used herein, the term Acascade refrigeration process@ means a refrigeration process that employs a plurality of refrigeration cycles, each employing a different pure component refrigerant to successively cool natural gas.

As used herein, the term Aopen-cycle cascaded refrigeration process@ refers to a cascaded refrigeration process comprising at least one closed refrigeration cycle and one open refrigeration cycle, where the boiling point of the refrigerant employed in the open cycle is less than the boiling point of the refrigerant employed in the closed cycle, and a portion of the cooling duty to condense the open-cycle refrigerant is provided by one or more of the closed cycles. In one embodiment of the present invention, a predominately methane stream is employed as the refrigerant in the open refrigeration cycle. This predominantly methane stream originates from the processed natural gas feed stream and can include the compressed open methane cycle gas streams.

As used herein, the term Aexpansion-type cooling@ refers to cooling which occurs when the pressure of a gas, liquid, or two-phase system is decreased by passage through a pressure reduction means. In one embodiment, the expansion means is a Joule-Thompson expansion valve. In another embodiment of the present invention, the expansion means is a hydraulic or gas expander.

As used herein, the term Amid-boiling point@ refers to the temperature at which half of the weight of a mixture of physical components has been vaporized (i.e., boiled off) at a specific pressure.

As used herein, the term Aindirect heat exchange@ refers to a process wherein the refrigerant cools the substance to be cooled without actual physical contact between the refrigerating agent and the substance to be cooled. Core-in-kettle heat exchangers and brazed aluminum plate-fin heat exchangers are specific examples of equipment that facilitate indirect heat exchange.

As used herein, the terms Aeconomizer@ or Aeconomizing heat exchanger@ refer to a configuration utilizing a plurality of heat exchangers employing indirect heat exchange means to efficiently transfer heat between process streams. Generally, economizers minimize outside energy inputs by heat integrating process streams with each other.

As used herein, the term Ahigher heating value@ or AHHV@ refers to a measure of the heat released when an LNG product is combusted, accounting for the energy required to vaporize the water that results from the combustion reaction.

As used herein, the term ABTU content@ is synonymous with the term Ahigher heating value.@

As used herein, the term Adistillation column@ or Aseparator@ refer to a device for separating a stream based on relative volatility.

As used herein, the term Asteady state operation@ shall mean periods of relatively steady and continuous operation between start-up and shut-down.

As used herein, the term Anon-feed operating parameter@ shall mean any operating parameter of an item of equipment or a facility other than the composition of the main feed(s) to that item of equipment or facility.

As used herein, the terms Anatural gas liquids@ or ANGL@ refer to mixtures of hydrocarbons whose components are, for example, typically heavier than ethane. Some examples of hydrocarbon components of NGL streams include propane, butane, and pentane isomers, benzene, toluene, and other aromatic molecules. Ethane may also be included in an NGL mixture.

As used herein, the terms Aupstream@ and Adownstream@ refer to the relative positions of various components of a natural gas liquefaction facility along the main flow path of natural gas through the plant.

As used herein, the terms Apredominantly,@ Aprimarily,@ Aprincipally,@ and Ain major portion,@ when used to describe the presence of a particular component of a fluid stream, means that the fluid stream comprises at least 50 mole percent of the stated component. For example, a Apredominantly@ methane stream, a Aprimarily@ methane stream, a stream Aprincipally@ comprised of methane, or a stream comprised Ain major portion@ of methane each denote a stream comprising at least 50 mole percent methane.

As used herein, the term Aand/or,@ when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms Acomprising,@ Acomprises,@ and Acomprise@ are open-ended transition terms used to transition from a subject recited before the term to one or elements recited after the term, where the element or elements listed after the transition term are not necessarily the only elements that make up of the subject.

As used herein, the terms Aincluding,@ Aincludes,@ and Ainclude@ have the same open-ended meaning as Acomprising,@ Acomprises,@ and Acomprise.@

As used herein, the terms Ahaving,@ Ahas,@ and Ahave@ have the same open-ended meaning as Acomprising,@ Acomprises,@ and Acomprise.@

As used herein, the terms Acontaining,@ Acontains,@ and Acontain@ have the same open-ended meaning as Acomprising,@ Acomprises,@ and Acomprise.@

As used herein, the terms Aa,@ Aan,@ Athe,@ and Asaid@ means one or more.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

What is claimed is:

1. A natural gas handling facility comprising:

a first distillation column comprising a first fluid inlet, a first vapor outlet, and a first liquid outlet;

a first heat exchanger defining a first heating pass and a first cooling pass, wherein said first heating pass defines a first cool fluid inlet and a first warm fluid outlet, wherein said first cooling pass defines a first warm fluid inlet and a first cool fluid outlet, wherein said first cool fluid inlet of said first heating pass is in fluid flow communication with said first liquid outlet of said first distillation column;

a second heat exchanger defining a second heating pass and a second cooling pass, wherein said second heating pass defines a second cool fluid inlet and a second warm fluid outlet, wherein said second cooling pass defines a second warm fluid inlet and a second cool fluid outlet, wherein said first warm fluid outlet of said first heating pass is in fluid flow communication with said second cool fluid inlet of said second heating pass;

an intermediate stage flash drum comprising a third fluid inlet, a third vapor outlet, and a third liquid outlet, wherein said third fluid inlet is in fluid flow communication with said first liquid outlet of said first distillation column;

a second distillation column comprising a second fluid inlet, a second vapor outlet, and a second liquid outlet, wherein said second fluid inlet of said second distillation column is in fluid flow communication with a composite stream formed from said second warm fluid outlet of said second heating pass and said third liquid outlet of said intermediate stage flash drum, wherein said second vapor outlet of said second distillation column is in fluid flow communication with said second warm fluid inlet of said second cooling pass, and wherein said first warm fluid outlet of said first heating pass is not in fluid flow communication with said first distillation column.

2. The facility of claim 1, further comprising an upstream refrigeration cycle defining a warm natural gas inlet and a cool natural gas outlet, wherein said cool natural gas outlet is in fluid flow communication with said first fluid inlet of said first distillation column.

3. The facility of claim 2, wherein said upstream refrigeration cycle comprises a propane, propylene, ethane, or ethane refrigeration cycle.

* * * * *